US009282845B2

(12) United States Patent
Byun

(10) Patent No.: US 9,282,845 B2
(45) Date of Patent: Mar. 15, 2016

(54) ROMAN SHADE TYPE BLIND FABRIC AND BLIND USING THE SAME

(75) Inventor: Tae Woong Byun, Daejeon (KR)

(73) Assignee: WINPLUS CO., LTD., Chungbuk (KR)

( * ) Notice: Subject to any disclaimer, the term of this patent is extended or adjusted under 35 U.S.C. 154(b) by 53 days.

(21) Appl. No.: 14/126,414

(22) PCT Filed: Jun. 14, 2012

(86) PCT No.: PCT/KR2012/004707

§ 371 (c)(1),
(2), (4) Date: Dec. 13, 2013

(87) PCT Pub. No.: WO2012/173412

PCT Pub. Date: Dec. 20, 2012

(65) Prior Publication Data

US 2014/0182793 A1 Jul. 3, 2014

(30) Foreign Application Priority Data

Jun. 15, 2011 (KR) ..... 10-2011-0058025

(51) Int. Cl.

| | |
|---|---|
| ***E06B 9/42*** | (2006.01) |
| ***A47H 23/04*** | (2006.01) |
| ***E06B 9/64*** | (2006.01) |
| *E06B 9/24* | (2006.01) |
| *E06B 9/262* | (2006.01) |
| *E06B 9/40* | (2006.01) |

(52) U.S. Cl.

CPC *A47H 23/04* (2013.01); *E06B 9/42* (2013.01); *E06B 9/64* (2013.01); *E06B 2009/2405* (2013.01); *E06B 2009/2447* (2013.01); *E06B 2009/2622* (2013.01); *E06B 2009/405* (2013.01)

(58) Field of Classification Search

CPC ..... E06B 2009/2405; E06B 2009/2622; E06B 9/64; E06B 9/42; E06B 2009/2447; E06B 2009/405; A47H 23/04

USPC ..... 160/85, 86, 84.01, 121.1

See application file for complete search history.

(56) References Cited

U.S. PATENT DOCUMENTS

| | | | | |
|---|---|---|---|---|
| 4,501,311 | A | 2/1985 | Folland | |
| 5,791,392 | A * | 8/1998 | Fernandez Lopez | 160/238 |
| 7,849,907 | B2 * | 12/2010 | Jang | 160/86 |
| 8,261,807 | B2 * | 9/2012 | Dann et al. | 160/84.01 |

(Continued)

FOREIGN PATENT DOCUMENTS

| | | |
|---|---|---|
| JP | 07-051156 | 2/1995 |
| JP | 10-018737 | 1/1998 |

(Continued)

*Primary Examiner* — Blair M Johnson

(74) *Attorney, Agent, or Firm* — Haynes and Boone, LLP

(57) ABSTRACT

The present invention relates to a roman blind fabric on which loops are formed and a roman blind using the same. More particularly, rings for inserting loop cords thereinto are woven integrally with a loop-forming fabric in such a manner as to be formed transversely and longitudinally at the time when the loop-forming fabric is woven, and the loop-forming fabric and a roll-up fabric are provided as a double layer to prevent the loop cord from being wrapped around the neck of a child. Further, the upper end of the loop-forming fabric is fixed to a frame; the upper ends of a roll-up fabric which is placed on the back side of the loop-forming fabric and a plurality of loop cords are fixed to a winding rod; and the lower ends of the loop-forming fabric, the roll-up fabric and the loop cords are fixed to a weight.

19 Claims, 30 Drawing Sheets

(56) References Cited

U.S. PATENT DOCUMENTS

| | | | | |
|---|---|---|---|---|
| 8,726,969 | B2 * | 5/2014 | Lin | 160/108 |
| 2010/0252209 | A1 | 10/2010 | Wang | |
| 2011/0061821 | A1 | 3/2011 | Kim | |
| 2011/0108206 | A1 | 5/2011 | Hsu et al. | |
| 2012/0227910 | A1 * | 9/2012 | Lin | 160/84.01 |
| 2014/0182793 | A1 * | 7/2014 | Byun | 160/84.06 |
| 2014/0367054 | A1 * | 12/2014 | Cha | 160/84.01 |

FOREIGN PATENT DOCUMENTS

| | | |
|---|---|---|
| JP | 3060613 | 6/1999 |
| JP | 2010-029272 | 2/2010 |
| JP | 2010-527420 | 8/2010 |
| KR | 200 365 028 | 10/2004 |
| KR | 200 444 019 | 4/2009 |
| KR | 100912862 | 8/2009 |
| KR | 20100060876 | 6/2010 |

* cited by examiner

Light-shielding portion

| | | | | | | | | | | | | | |
|---|---|---|---|---|---|---|---|---|---|---|---|---|---|
| 1 | | | | 5 | | | 8 | | | 11 | | | 14 |
| | 2 | 3 | | | 6 | | | 9 | | | 12 | | |
| 1 | | | 4 | | | 7 | | | 10 | | | 13 | |
| | 2 | 3 | | | 6 | | | 9 | | | 12 | | |
| 1 | | | | 5 | | | 8 | | | 11 | | | 14 |
| | 2 | 3 | | | 6 | | | 9 | | | 12 | | |
| 1 | | | 4 | | | 7 | | | 10 | | | 13 | |
| | 2 | 3 | | | 6 | | | 9 | | | 12 | | |

| | | | | | | | | | | | | | |
|---|---|---|---|---|---|---|---|---|---|---|---|---|---|
| 1 | | | 4 | | 6 | | 8 | | 10 | | 12 | | 14 |
| | 2 | 3 | | 5 | | 7 | | 9 | | 11 | | 13 | |
| 1 | | | 4 | | 6 | | 8 | 9 | 10 | 11 | 12 | 13 | 14 |
| | 2 | 3 | | 5 | | 7 | | 9 | 10 | 11 | 12 | 13 | 14 |
| 1 | | | 4 | | 6 | | 8 | 9 | 10 | 11 | 12 | 13 | 14 |
| | 2 | 3 | | 5 | | 7 | | 9 | 10 | 11 | 12 | 13 | 14 |
| 1 | | | 4 | | 6 | | 8 | | 10 | | 12 | | 14 |
| | 2 | 3 | | 5 | | 7 | | 9 | | 11 | | 13 | |

Light-transmitting portion

| | | | | | | | | | | | | | |
|---|---|---|---|---|---|---|---|---|---|---|---|---|---|
| 1 | | | 4 | | 6 | | 8 | | 10 | | 12 | | 14 |
| | 2 | 3 | 4 | 5 | | | | 9 | 10 | 11 | | | |
| 1 | | | 4 | | 6 | | 8 | | 10 | | 12 | | 14 |
| | 2 | 3 | | | | | | 9 | | | | | |
| 1 | | 3 | | | 6 | | | 9 | | | 12 | | |
| | 2 | | | | 6 | | | | | | 12 | | |
| 1 | 2 | 3 | 4 | 5 | 6 | 7 | 8 | 9 | 10 | 11 | 12 | 13 | 14 |

Fig. 6

ROMAN SHADE TYPE BLIND FABRIC AND BLIND USING THE SAME

CROSS-REFERENCE TO RELATED APPLICATIONS

This application is a §371 National Stage of International Patent Application No. PCT/KR2012/004707 filed Jun. 14, 2012 and entitled "ROMAN SHADE TYPE BLIND PAPER AND BLIND USING SAME" which is hereby incorporated by reference in its entirety.

International Patent Application No. PCT/KR2012/004707 claims the benefit of Korean Patent Application No. 10-2011-0058025 filed Jun. 15, 2011, which is hereby incorporated by reference in its entirety.

TECHNICAL FIELD

The present invention relates to a blind fabric for a roman shade type blind (hereinafter called "a roman blind") on which loops are formed and a roman blind using the same, and more particularly, to a roman blind fabric and a roman blind using the same wherein rings for inserting loop cords thereinto are integrally woven on the back surface of a loop-forming fabric at the time when the loop-forming fabric is woven, and the loop-forming fabric and a roll-up fabric are provided as a double layer to previously prevent the loop cords from being wrapped around the neck of a child.

BACKGROUND

Generally, curtains and blinds are installed on the windows or entrance doors of buildings to block sunlight, to block prying eyes from outside, to reduce noise, and to protect against the cold, and the like. In addition to such practical purposes, they are also used as an important part of indoor decoration for improving the indoor appearance through desired color combinations with the indoor walls or glass.

Curtains and blinds may be classified as curtains of a general type that can be folded and unfolded from the center to both sides, vertical blinds that are segmented into a plurality of panels adjustable in their inclination angles, roll screens having a one- or two-layer blind fabric that can be wound or unwound on/from a rotatable winding rod, or roman blinds that can be folded in up and down directions through the winding operation of loop cords.

One of conventional roman blinds is disclosed in Korean Utility Model Registration No. 20-0444019, and FIGS. 1 to 5*b* show the conventional roman blind. FIG. 1 is a perspective view showing the conventional roman blind, and FIG. 2 is a perspective view showing the back surface of the conventional roman blind of FIG. 1. FIG. 3 is an enlarged view showing a portion "A" of FIG. 2, wherein the conventional roman blind includes a frame 10, a loop-forming fabric 11, loop cord-supporting portions 12, and a weight 13. FIG. 4 is a longitudinal sectional view of FIG. 3, and FIGS. 5*a* and 5*b* are longitudinal sectional views of FIG. 1.

The frame 10, which is mounted on the top portion of a window, has an appropriate length corresponding to the length of the window, and a winding rod 14 is rotatably disposed inside the frame 10. Further, a winding unit 15 is mounted at one side of the winding rod 14, and the winding rod 14 is rotated by pulling an adjustment cord 16 connected to the winding unit 15.

The loop-forming fabric 11 is fixed at one end thereof to the inside of the front surface of the frame 10. Also, the loop cords 17 are fixed at one end thereof to the winding rod 14 rotatably mounted in the frame 10, and fixed at the other end thereof to the weight 13 adapted to maintain the loop-forming fabric 11 in a tense state at the time when the loop-forming fabric 11 is unfolded.

On the other hand, as shown in FIG. 2, the loop cords 17, which are fixed at one end thereof to the winding rod 14, are inserted into the loop cord-supporting portions 12 formed on the back surface of the loop-forming fabric 11, and as shown in FIG. 4, each loop cord-supporting portion 12 includes a decoration body 19 from which a connection pin 18 is protruded, and a decoration fixing member 21 to which a connection ring 20 is attached, so that the connection pin 18 of the decoration body 19 is passed through the loop-forming fabric 11 and fixed to the decoration fixing member 21, thereby integrally coupling the decoration body 19 with the decoration fixing member 21 to form each loop cord-supporting portion 12.

That is, the decoration body 19 of the loop cord-supporting portion 12 is fitted to each of holes 22 formed spaced apart from each other by a given distance transversely and longitudinally on the loop-forming fabric 11, and next, the loop cords 17 are passed through the connection rings 20 exposed to the back surface of the loop-forming fabric 11, thereby completing the assembling work of the loop-forming fabric 11.

After that, the upper end of the loop-forming fabric 11 fixed at the lower end thereof to the weight 13 is fixed to the inside of the front surface of the frame 10, and the upper ends of the loop cords 17 are then fixed to the winding rod 14, thereby finishing the assembling work of the roman blind.

In the state where the loop-forming fabric 11 is completely unfolded, as shown in FIGS. 1 and 5*a*, it fully covers the window to shield the indoors and outdoors.

In this state, if the adjustment cord 16 is pulled by a user, the winding rod 14 connected to the winding unit 15 is rotated to wind the loop cords 17, and thus, the loop cord-supporting portions 12 formed on the lowermost end of the loop-forming fabric 11 to which the loop cords 17 are fixed are moved upwardly. At this time, the loop cords 17 are guided and moved stably by the connection rings 20 of the loop cord-supporting portions 12.

The loop cord-supporting portions 12, which move upwardly in the state of being connected to the loop cords 17, are raised together with the weight 13, in the state of being formed in a plurality of columns inclusive of both sides and center of the loop-forming fabric 11, and as the lower portion of the loop-forming fabric 11 is moved upwardly to the same speed and height, if the loop cord-supporting portions 12 are contacted with the adjacent upper side loop cord-supporting portions 12 as shown in FIG. 5*b*, the loop-forming fabric 11 is folded sequentially to form the loops thereon.

Conversely, if the adjustment cord 16 is pulled in the opposite direction to the direction as mentioned above to unfold the loop-forming fabric 11 downwardly, the loop cords 17 are unwound at the same time from the winding rod 14, and thus, the loop-forming fabric 11 is naturally moved downwardly by the self-weight of the weight 13 to cover the window.

However, the loop-forming fabric used for the roman blind having the above-mentioned structure and the roman blind using the loop-forming fabric have the following problems.

First, so as to form the loop cord-supporting portions in such a manner as to be exposed to the back surface of the loop-forming fabric, the holes should be formed spaced apart from each other by a given distance transversely and longitudinally on the loop-forming fabric, and next, the decoration body of each loop cord-supporting portion should be passed through the holes, while the connection rings are being separately coupled to the decoration fixing members, thereby making the time needed for the assembling work of the loop-forming fabric substantially delayed to decrease the productivity of the loop-forming fabric.

Second, the decoration body of each loop cord-supporting portion is fitted to each hole formed on the loop-forming fabric, thereby making the loop cord-supporting portion easily deviate from the loop-forming fabric while in use.

Third, the decoration body is exposed on the front surface of the loop-forming fabric, thereby making the outer appearance of the loop-forming fabric look bad.

Fourth, the loop cords adapted to form the loops on the loop-forming fabric are exposed to the back surface of the loop-forming fabric, and in the state where the loop-forming fabric is moved downwardly to completely cover the window, the loop cords may be pulled and cut by a child playing behind the loop-forming fabric or they are wrapped around his neck, so that a safety device for preventing the loop cords from being exposed to the outside has been legally introduced and developed in the U.S.A. and Europe, and other countries.

Fifth, the loop-forming fabric is a single layer, and in the state where it is positioned at the lower dead point, the daylight collection and ventilation of the indoors are not achieved, such that it required winding up of the loop-forming fabric to achieve this.

Sixth, while one conventional roman blind disclosed in Korean Utility Model Registration No. 20-0365028 entitled 'Height and Brightness Adjustment Type Blind' may permit daylight collection and ventilation even when the blind fabric is positioned at the lower dead point by providing a blind fabric with continuously formed light-transmitting portions and light-shielding portions, this conventional technique leads to an increase in the whole outer diameter of the winding rod and in turn in the overall size of the frame, and thus makes it difficult to open windows rapidly. This is because a weight is located on a folded blind fabric, and the blind fabric is fixed at one end thereof to a frame and at the other end thereof to a winding rod, such that to completely open windows both layers of the blind fabric have to be completely wound on the winding rod. This is especially problematic, for example, for theaters, churches, gyms, hotel lobbies, airports and the like that have tall windows due to their high story heights.

Seventh, according to the conventional roman blind disclosed in Korean Utility Model Registration No. 20-0365028, the weight located on the loops is moved up and down to open and close the window, which only allows the applicability of the blind fabric to a single kind of integrated fabric that cannot have front and back fabrics of differing color or thickness to provide various indoor atmospheres.

SUMMARY

Accordingly, the present invention has been made in view of the above-mentioned problems occurring in the prior art, and it is an objective of the present invention to provide a roman blind fabric and a roman blind using the same that has rings through which loop cords are passed woven integrally with a loop-forming fabric in such a manner as to be spaced apart from each other by a given distance transversely and longitudinally on the back surface of the loop-forming fabric at the time when the loop-forming fabric is woven, thereby maximizing the efficiency of producing the loop-forming fabric as the roman blind fabric.

It is another objective of the present invention to provide a roman blind fabric and a roman blind using the same that has a roll-up fabric provided independently behind a loop-forming fabric having loop cords inserted thereinto and a weight provided to fix the lower ends of the roll-up fabric and the loop-forming fabric thereto, thereby removing various problems caused by the exposure of the loop cords to the outside.

It is still another objective, of the present invention to provide a roman blind fabric and a roman blind using the same that is configured to have a roll-up fabric and loop cords wound on a winding rod, and a loop-forming fabric fixed at one end thereto to a frame so as to form loops continuously on the loop-forming fabric, thereby providing the two layer fabric having light-transmitting portions and light-shielding portions formed thereon.

It is yet still another objective of the present invention to provide a roman blind fabric and a roman blind using the same that has a roll-up fabric provided independently behind a loop-forming fabric having loop cords inserted thereinto and a weight provided to fix the lower ends of the roll-up fabric and the loop-forming fabric thereto, so that in the state where the loop-forming fabric is lowered completely to the lower dead point, the light-transmitting portions and the light-shielding portions of the roll-up fabric and the loop-forming fabric are located to correspond to each other, without having any loops on the loop-forming fabric, thereby achieving daylight collection and ventilation of the indoors.

To accomplish the above objectives, according to a first aspect of the present invention, there is provided a roman blind fabric that has rings through which loop cords are passed woven integrally with a loop-forming fabric in such a manner as to be spaced apart from each other by a given distance transversely and longitudinally on the back surface of the loop-forming fabric at the time when the loop-forming fabric is woven.

To accomplish the above objectives, according to a second aspect of the present invention, there is provided a roman blind having a frame, a winding rod, a weight, and a blind fabric having a loop-forming fabric and a roll-up fabric, so that when an adjustment cord adapted to activate a winding unit is pulled, loops are formed on the loop-forming fabric, wherein the winding rod is mounted rotatably on the frame, the upper end of the roll-up fabric located behind the loop-forming fabric and the upper ends of loop cords adapted to be inserted into rings formed on the loop-forming fabric are fixed to the winding rod, the upper end of the loop-forming fabric is fixed to the frame, the lower ends of the loop-forming fabric, the loop cords, and the roll-up fabric are fixed to the weight, and the rings into which the loop cords are inserted are woven integrally with the loop-forming fabric in such a manner as to be spaced apart from each other by a given distance transversely and longitudinally on the back surface of the loop-forming fabric at the time when the loop-forming fabric is woven.

The roman blind fabric and the roman blind using the same according to the present invention have more excellent advantages when compared with conventional roman blinds or roll screens, and the advantages are as follows:

First, the rings into which the loop cords are inserted are automatically formed and spaced apart from each other by a given distance transversely and longitudinally on the back surface of the loop-forming fabric at the time when the loop-forming fabric is woven, so that there is no need for coupling the separate loop cord-supporting portions to the loop-forming fabric in the conventional practice, thereby increasing the productivity of the loop-forming fabric and greatly reducing the production cost thereof.

Second, if the loop cords are automatically inserted into the rings at the time when the loop-forming fabric is woven, there is no need for inserting the loop cords into the loop cord-supporting portions one by one, thereby increasing the productivity of the loop-forming fabric and greatly reducing the production cost thereof.

Third, the loop cord-supporting portions are not exposed on the front surface of the loop-forming fabric, thereby making the outer appearance of the loop-forming fabric look good.

Fourth, the roll-up fabric is located at one side of the loop-forming fabric into which the loop cords are inserted, and therefore, the loop cords are not exposed to the outside, thereby previously preventing the loop cords from being cut or wrapped around a child and also overcoming the legislation of a safety device for preventing the loop cords from being exposed to the outside.

Fifth, if the roman blind fabric has the light-transmitting portions and the light-shielding portions formed continuously thereon, daylight collection and ventilation of the indoors are achieved even in the state where the roll-up fabric is wound by a given quantity on the winding rod to form the loops on the loop-forming fabric. That is, even in the state where a portion of window is open, the light-transmitting portions and the light-shielding portions of the roll-up fabric and the loop-forming fabric are arranged alternately to each other, and thus the daylight collection and ventilation of the indoors are achieved.

Sixth, when the roll-up fabric and the loop cords fixed at one end thereof to the weight are wound on the winding rod, the loops are formed on the loop-forming fabric fixed at one end thereof to the frame, so that only if the roll-up fabric is wound on the winding rod, the window is completely open, which decreases the whole outer diameter of the winding rod on which the roll-up fabric is wound to cause the total size of the frame to be reduced, and the quantity of roll-up fabric wound on the winding rod can be reduced to allow windows having high heights, for example, in theaters, churches, gyms, hotel lobbies, airports and the like, to be opened rapidly.

Seventh, the roll-up fabric, the loop-forming fabric and the loop cords are fixed to any one side of the weight, and therefore, in the state where the window is closed by means of the roll-up fabric and the loop-forming fabric, the indoor atmospheres are improved and the daylight collection and ventilation of indoors can be achieved without having any loops formed on the lower end of the loop-forming fabric.

Eighth, one end of the upper portion of the loop-forming fabric is fixed to the frame, one end of the upper portion of the roll-up fabric is fixed to the winding rod, the bottom portions of the other ends of the loop-forming fabric and the roll-up fabric are fixed to any one side of the weight together with the loop cords, so that the loop-forming fabric and the roll-up fabric have different colors, thicknesses, and tissues from each other in accordance with the colors of the interior of the building, thereby providing various indoor atmospheres.

Ninth, the roll-up fabric adapted to be wound on the winding rod is made of a thin material and the loop-forming fabric is made of a thick material, so that even in the winter season where the outside temperature is low, the roman blind having a relatively thick material can be provided, while minimizing the increment of the outer diameter of the winding rod when the roll-up fabric is wound on the winding rod.

BRIEF DESCRIPTION OF THE DRAWINGS

FIG. 6 is an organization chart showing a weaving method of a loop-forming fabric according to the present invention.

FIGS. 12*a* and 12*b* are longitudinal sectional views of FIG. 11, wherein FIG. 12*a* shows the loop-forming fabric being completely unfolded and FIG. 12*b* shows the loops formed on the loop-forming fabric as a roll-up fabric is wound on a winding rod.

FIGS. 16*a* and 16*b* are longitudinal sectional views of FIG. 15, wherein FIG. 16*a* shows the light-transmitting portions and the light-shielding portions of the loop-forming fabric being arranged alternately with those of the roll-up fabric and FIG. 16*b* shows the light-transmitting portions and the light-shielding portions of the loop-forming fabric being arranged correspondingly to those of the roll-up fabric.

DETAILED DESCRIPTION

Figure 1:
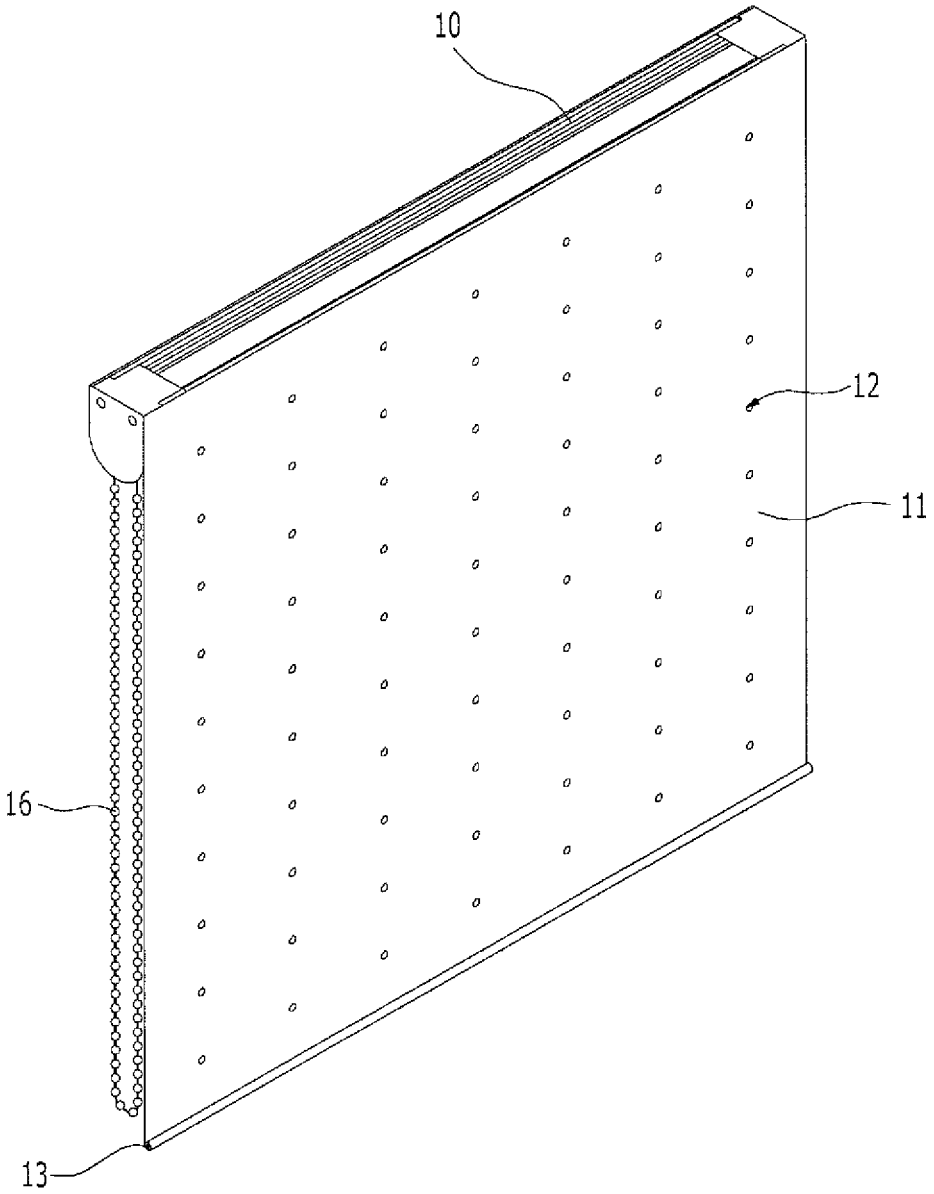
FIG. 1 is a perspective view showing a conventional roman blind.
Figure 2:
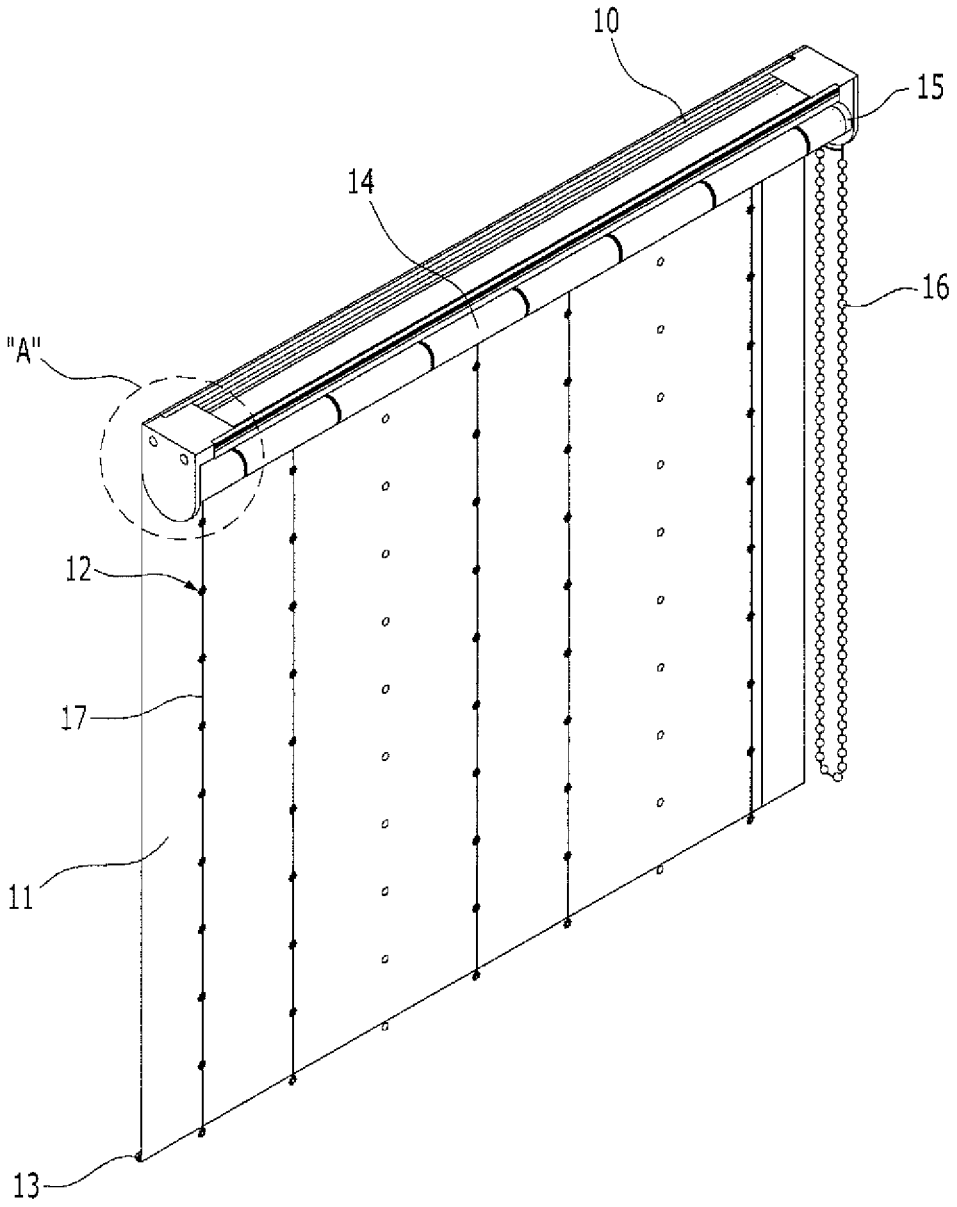
FIG. 2 is a perspective view showing the back surface of the conventional roman blind of FIG. 1.
Figure 3:
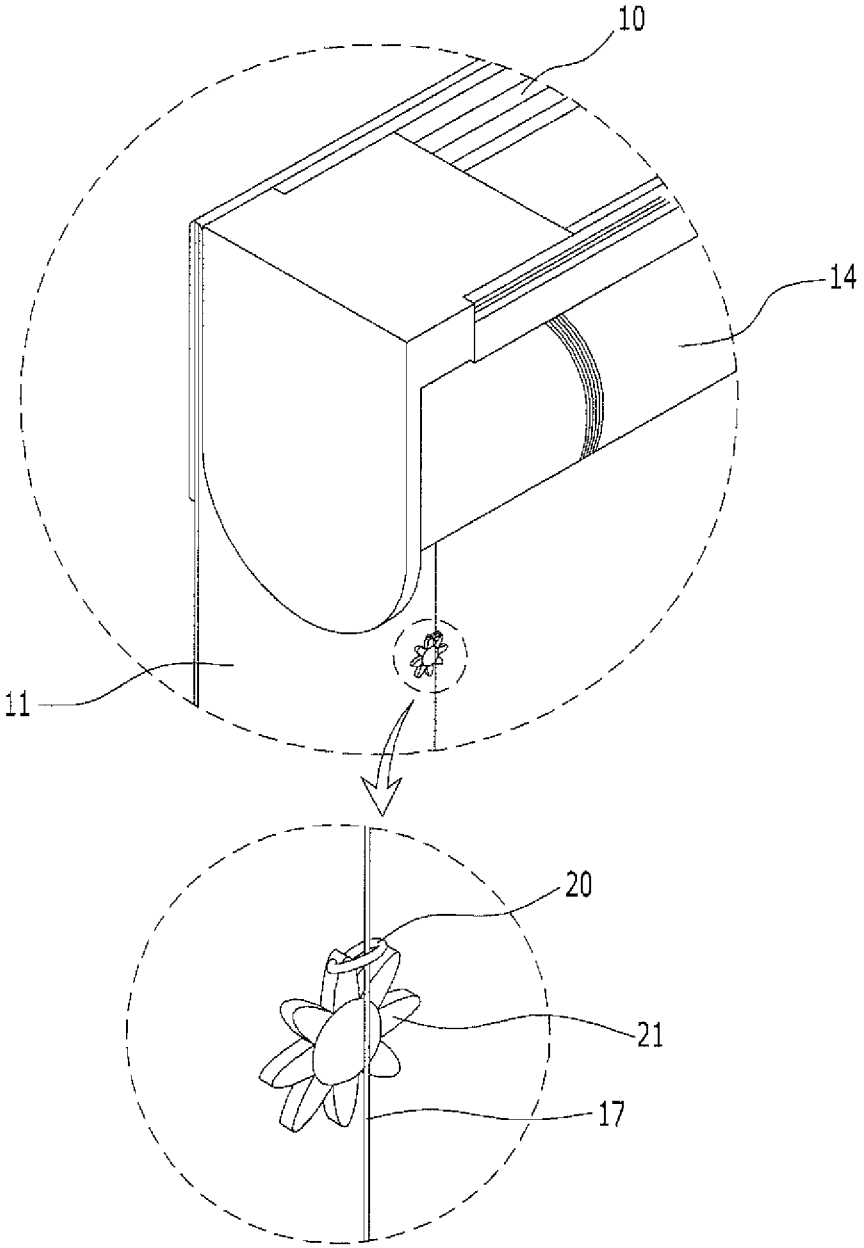
FIG. 3 is an enlarged view showing a portion "A" of FIG. 2.
Figure 4:
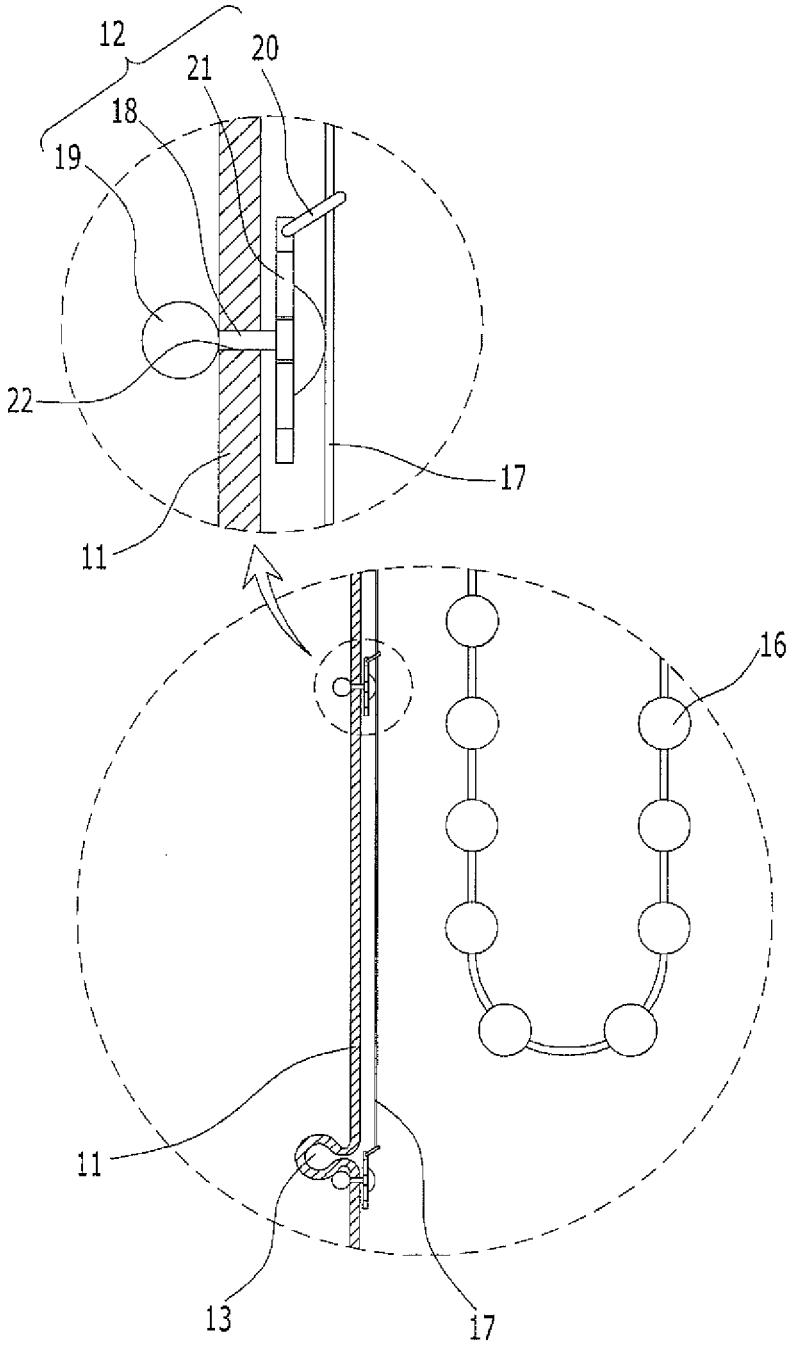
FIG. 4 is a longitudinal sectional view of FIG. 3.
Figure 5A:
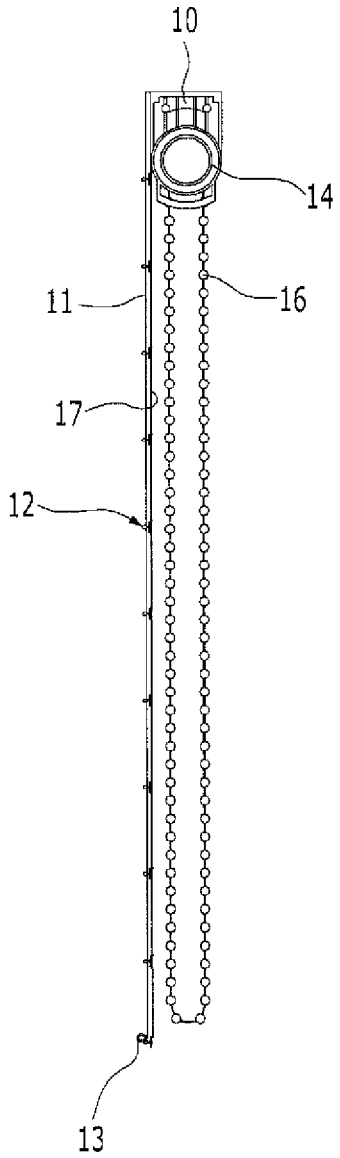
FIGS. 5*a* and 5*b* are longitudinal sectional views of FIG. 1.
Figure 5B:
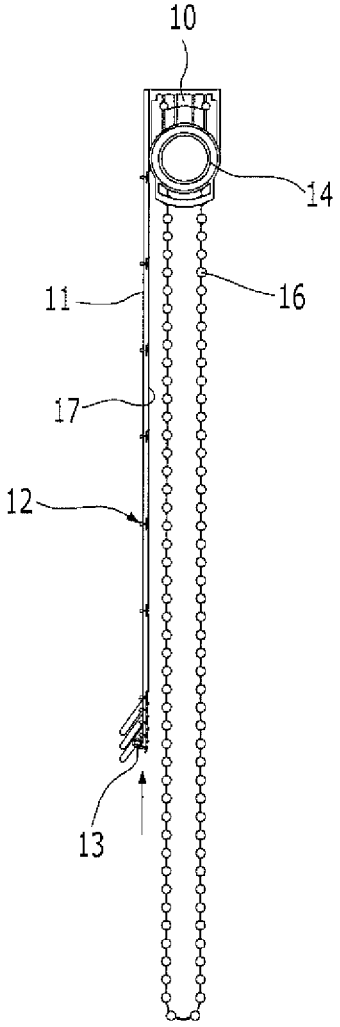

The above-mentioned objectives, features and advantages will be more apparent with reference to preferred embodiments of the present invention as will be described below.

The explanation on the specific structure and functions are given just to define the preferred embodiments of the present invention, and the preferred embodiments of the present invention may be provided in various manners, which are not limited to the embodiments described below.

The present invention should not be limited to the preferred embodiment described below, but may be modified in various forms without departing the spirit of the invention. Therefore, the various embodiments of the invention will be in detail explained with reference to the attached drawings. However, it should be understood that the invention is not limited to the preferred embodiment of the present invention, and many changes, variations and modifications of the constructional details illustrated and described may be resorted to without departing from the spirit of the invention.

The terms used in the present invention are used to explain the preferred embodiments of the present invention, which do not define the present invention. A singular expression includes a plural expression if there is no difference between them in the context. In the description of the invention, the terms such as "includes" or "comprises" are used to define the existence of features, numbers, steps, operations, components, parts, or their combinations, and to further include the possibility of one or more features, numbers, steps, operations, components, parts, or their combinations.

In the description of the invention with reference to the attached drawings, further, the same components are indicated by the same reference numerals as each other, and for the brevity of the description, the explanation on their repeated features will be avoided. If it is determined that the detailed description on the known technology related to the invention makes the spirit of the invention unclear, it will be also avoided.

Hereinafter, an explanation on a fabric for a roman blind and a roman blind using the fabric according to the preferred embodiments of the present invention will be in detail given with reference to the attached drawings. The parts or components corresponding to each other in the drawings are indicated by corresponding reference numerals.

Figure 7:
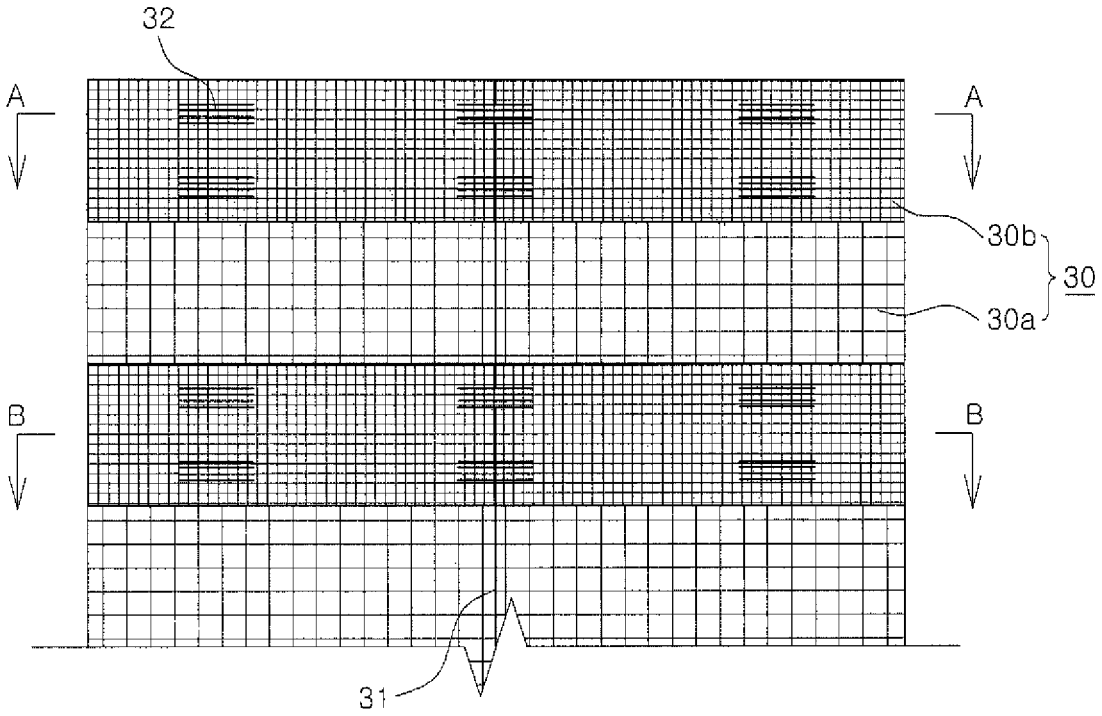
FIG. 7 shows the back surface of the loop-forming fabric according to the present invention.
Figure 8A:
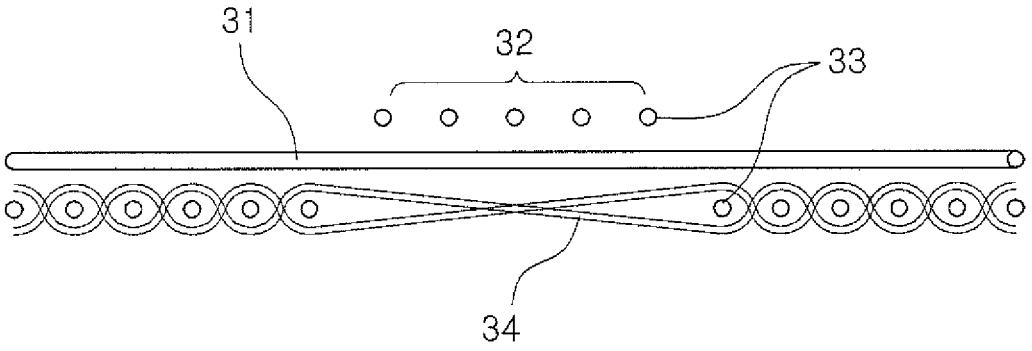
FIGS. 8*a* and 8*b* are sectional views taken along the lines A-A and B-B of FIG. 7.
Figure 8B:
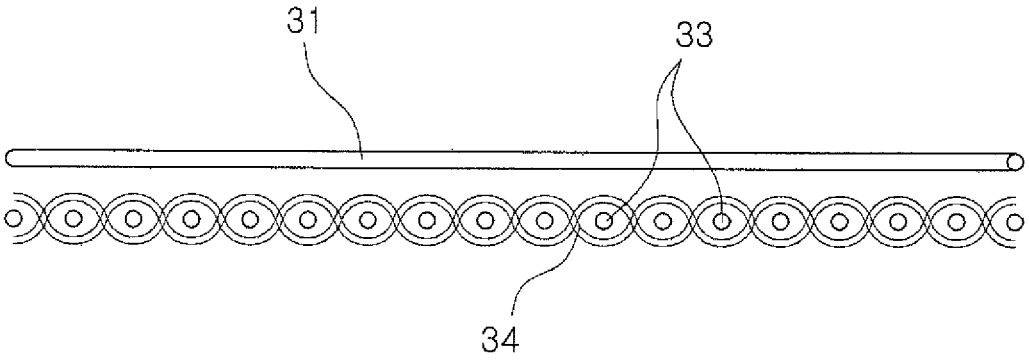

FIG. 6 is an organization chart showing a weaving method of a loop-forming fabric according to the present invention, FIG. 7 shows the back surface of the loop-forming fabric according to the present invention, and FIGS. 8*a* and 8*b* are sectional views taken along the lines A-A and B-B of FIG. 7. As shown in FIG. 7, a loop-forming fabric 30 as a roman blind fabric applied to the present invention has rings 32 through which loop cords 31 are passed and integrally formed with a loop-forming fabric 30 in such a manner as to be formed transversely and longitudinally on the back surface thereof at the time when the loop-forming fabric 30 is woven.

After the rings 32 have been formed at the time when the loop-forming fabric 30 is woven, the loop cords 31 are passed through the rings 32, but in consideration of the productivity, preferably, the loop cords 31 are passed through the rings 32 at the time when the loop-forming fabric 30 is woven.

The insertion of the loop cords 31 into the rings 32 is achieved in such a manner that the loop cords 31 are held at the time of holding warp yarns 34 onto a weaving machine (not shown) and in the process where weft yarns 33 are supplied to the warp yarns 34, they are passed over the loop cord 31 at the region where the ring 32 is formed as shown in FIG. 8*a*, whereas the loop cord 31 are being passed over the weft yarns 33 at the region where the ring 32 is not formed as shown in FIG. 8*b*.

Figure 9:
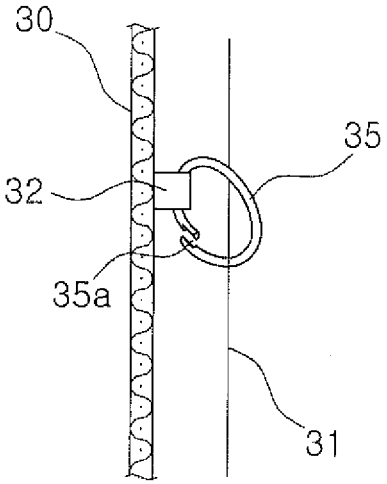
FIG. 9 is a side view showing a loop cord-supporting ring inserted into a ring formed on the back surface of the loop-forming fabric.

FIG. 9 is a side view showing a loop cord-supporting ring inserted into a ring formed on the back surface of the loop-forming fabric. If in the process of manually passing the loop cord 31 through the ring 32 the loop cord 31 is not passed through any one of the rings 32, a loop would not formed at the point where the loop cord 31 is not passed through the ring 32, which causes a serious defect. Accordingly, as shown in FIG. 9, in some embodiments a loop cord-supporting ring 35 may also be fixed to the ring 32 to allow the loop cord 31 to be passed therethrough.

The loop cord-supporting ring 35 may have a ring made of a metal or synthetic resin material having an overlapping portion 35*a* or may have a band (not shown) having a connected portion connected by means of connecting means (bonding or Velcro®).

The loop-forming fabric 30 may be woven to have just light-shielding portions. Further, if necessary, light-transmitting portions and light-shielding portions are repeatedly woven to achieve daylight collection and ventilation of the indoors, without having any operation of winding the roll-up fabric onto a winding rod.

Figure 10:
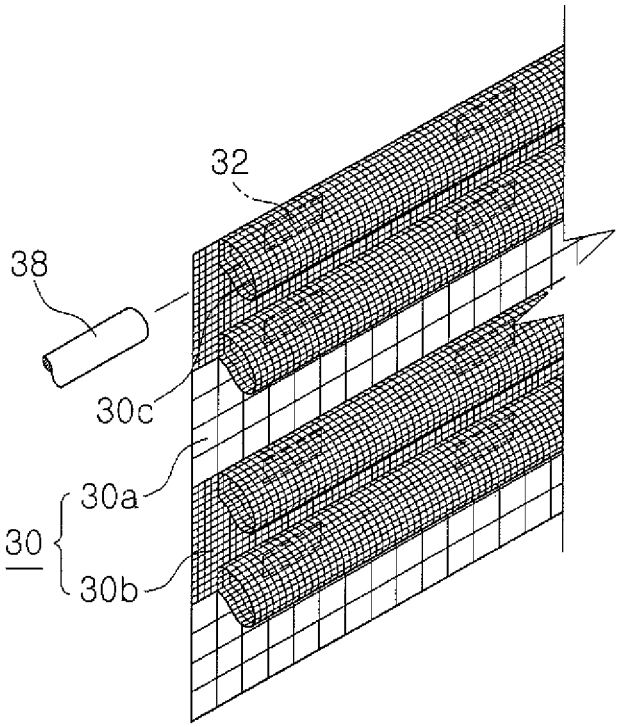
FIG. 10 is a perspective view showing an insertion portion formed on the front surface of the loop-forming fabric.

FIG. 10 is a perspective view showing an insertion portion formed on the front surface of the loop-forming fabric. In case of the loop-forming fabric 30 where the light-transmitting portions 30*a* and the light-shielding portions 30*b* are formed alternately and repeatedly, as shown in FIG. 10, at least one insertion portion 30*c* is formed transversely to have two layers on the light-shielding portions 30*b*, and a rod 38 is inserted into the insertion portion 30*c*, thereby providing various indoor atmospheres.

Further, as shown in FIG. 7, in case of the loop-forming fabric 30 where the light-transmitting portions 30*a* and the light-shielding portions 30*b* are formed alternately and repeatedly, the loop cords 31 passed through the rings 32 may have the same colors as the loop-forming fabric 30, but the loop cords 31 may be exposed to the outside through the light-transmitting portions 30*a*, which makes the outer appearance thereof looks bad. Therefore, it may be more desirable to have the loop cords 31 made of a transparent material.

Hereinafter, an explanation on a structure of a blind using the roman blind fabric as mentioned above will be given.

Figure 11:
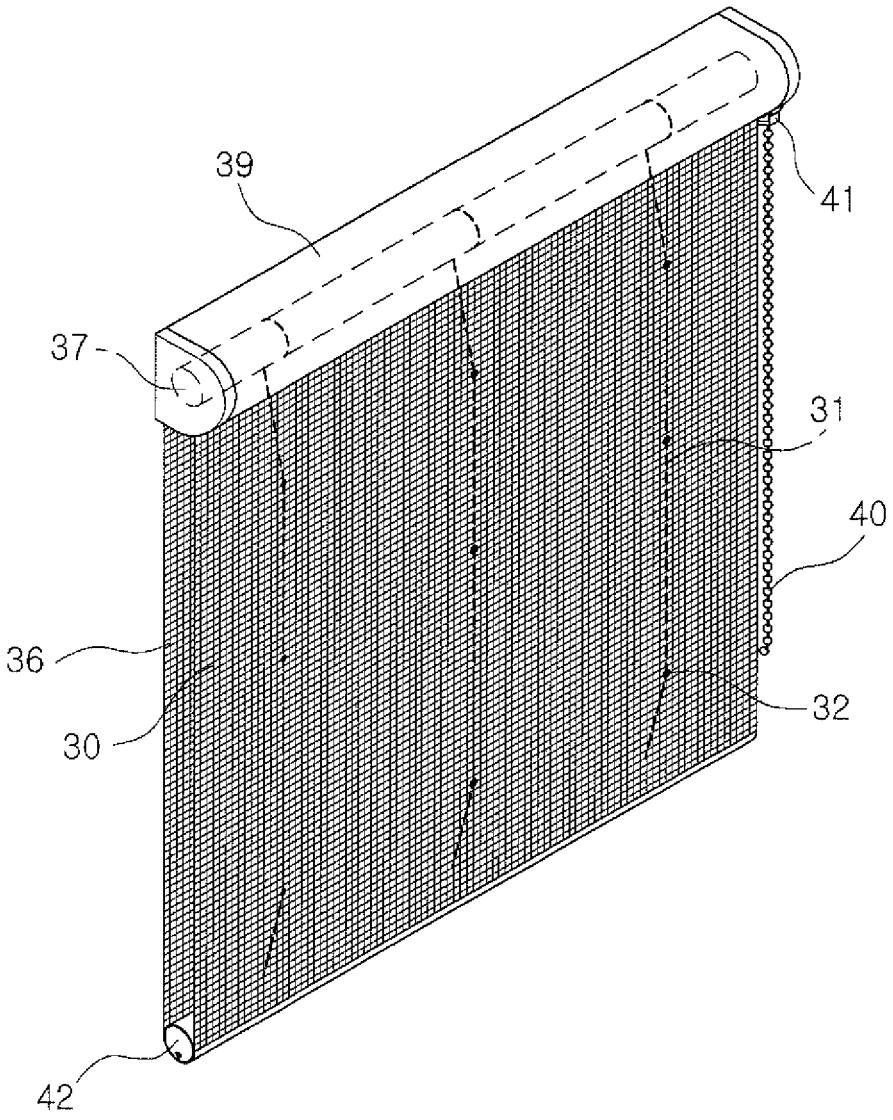
FIG. 11 is a perspective view showing a roman blind according to a first embodiment of the present invention.
Figure 12A:
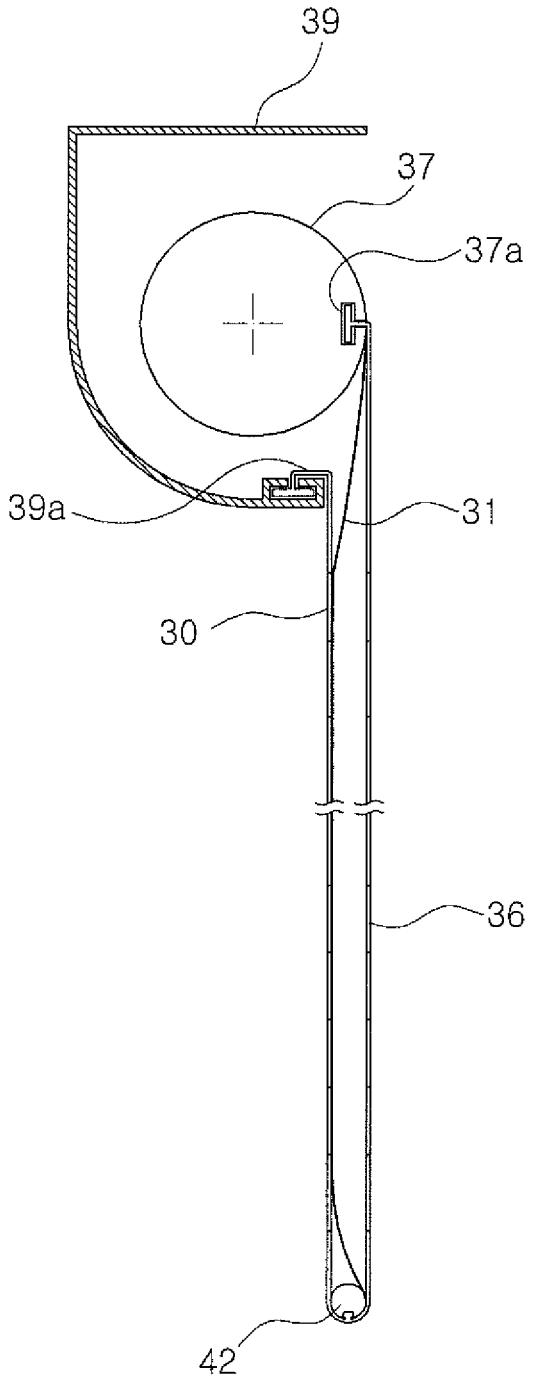
Figure 12B:
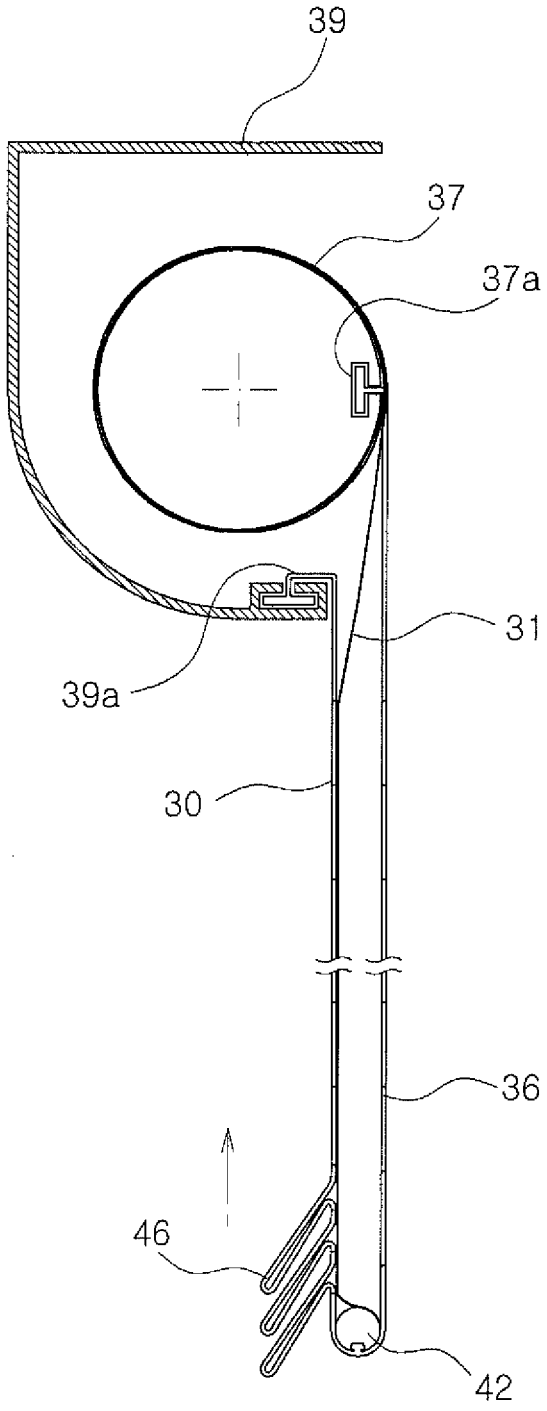

FIG. 11 is a perspective view showing a roman blind according to a first embodiment of the present invention, and FIGS. 12*a* and 12*b* are longitudinal sectional views of FIG. 11. According to the present invention, the roman blind is structured wherein a winding rod 37 is rotatably mounted on a frame 39 and a roll-up fabric 36 and loop cords 31 are fixed at one end thereof to a mounting groove 37*a* formed on the winding rod 37, so that a winding unit 41 is rotated by pulling an adjustment cord 40 by means of a user's manipulation to wind or unwind the roll-up fabric 36 and the loop cords 31 on or from the winding rod 37.

Further, the loop cords 31 are fixed to the upper end of the roll-up fabric 36, without having any mounting groove 37*a* on the winding rod 37, and the roll-up fabric 36 to which the loop cords 31 are fixed is detachably fixed to the winding rod 37 by means of Velcro® tape (not shown). The roll-up fabric 36 used in the blind according to the present invention may be woven in the same manner as the loop-forming fabric 30 or may be used with a typical blind fabric.

The loop-forming fabric 30 is disposed on the side facing the roll-up fabric 36 in such a manner as to be fixed on one end thereof to the frame 39, and as shown in FIG. 12*a*, the loop-forming fabric 30 is fixed to a mounting groove 39*a* formed on the lower end of the front surface of the frame 39.

Figure 13A:
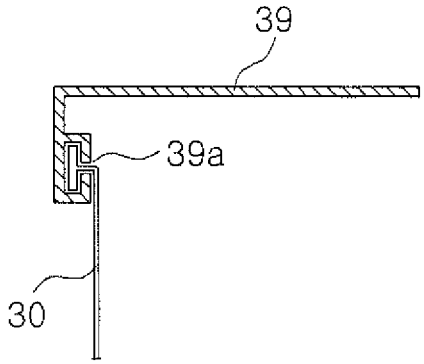
FIGS. 13*a* to 13*c* are sectional views showing different fixing positions of the loop-forming fabric according to the first embodiment of the present invention.
Figure 13B:
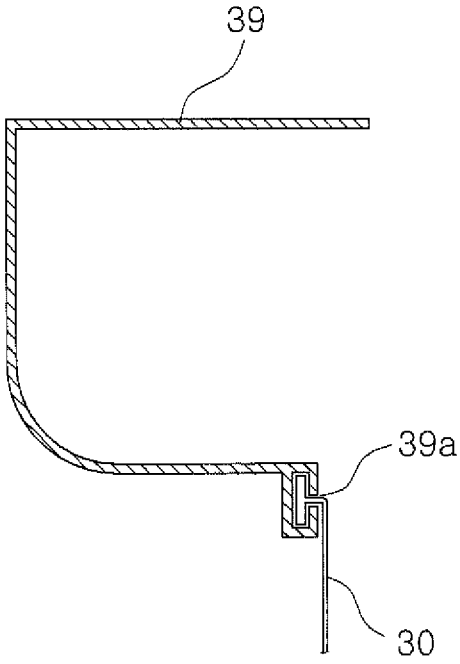
Figure 13C:
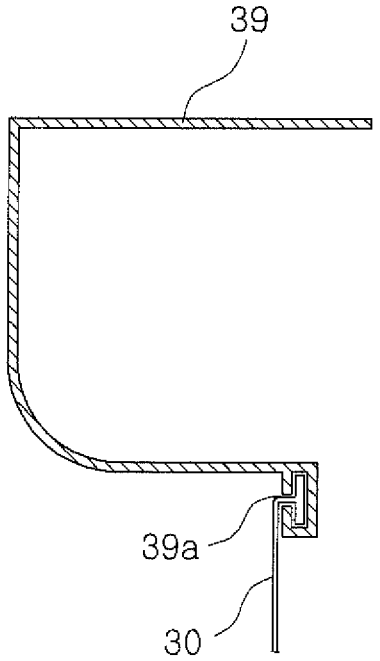

FIGS. 13*a* to 13*c* are sectional views showing different fixing positions of the loop-forming fabric according to the first embodiment of the present invention. As shown in FIG. 13*a*, the mounting groove 39*a* may be formed on the upper end of the front surface of the frame 39, and as shown in FIGS.

13*b* and 13*c*, the mounting groove 39*a* may be formed on the inside or outside of the front surface of the frame 39.

The rings 32 are formed spaced apart from each other by a given distance transversely and longitudinally on the back surface of the loop-forming fabric 30 in such a manner as to be woven integrally with the loop-forming fabric 30, and if the loop cords 31 are passed through the rings 32 at the time when the loop-forming fabric 30 is woven, the loop cords 31 are fixed to the winding rod 37. On the other hand, if the loop cords 31 are not passed through the rings 32 at the time when the loop-forming fabric 30 is woven, the loop cords 31 are passed through the rings 32 in such a manner as to be fixed at one end thereof to the winding rod 37 and fixed at the other end thereof to the weight 42, together with the loop-forming fabric 30 and the roll-up fabric 36.

Figure 14:
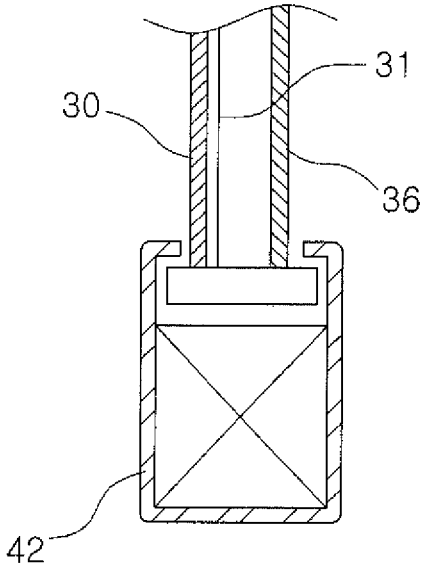
FIG. 14 is a longitudinal sectional view showing a weight of the roman blind according to the first embodiment of the present invention.

FIG. 14 is a longitudinal sectional view showing a weight of the roman blind according to the first embodiment of the present invention. The loop-forming fabric 30, the roll-up fabric 36, and the loop cords 31 are fixed to the weight 42, as shown in FIG. 14, and if the roll-up fabric 36 and the loop cords 31 are wound or unwound on/from the winding rod 37 by pulling the adjustment cord 40, they are moved up or down together with the weight 42.

In FIG. 11 showing the first embodiment of the present invention, the loop-forming fabric 30 and the roll-up fabric 36 are made of light-shielding materials, so that the indoor is not seen from the outdoor. If necessary, however, they may have the light-shielding portions and the light-transmitting portions formed alternately thereon, thereby achieving daylight collection and ventilation of the indoor, without having any operation of winding the roll-up fabric 36 covering the window on the winding rod 37.

Figure 15:
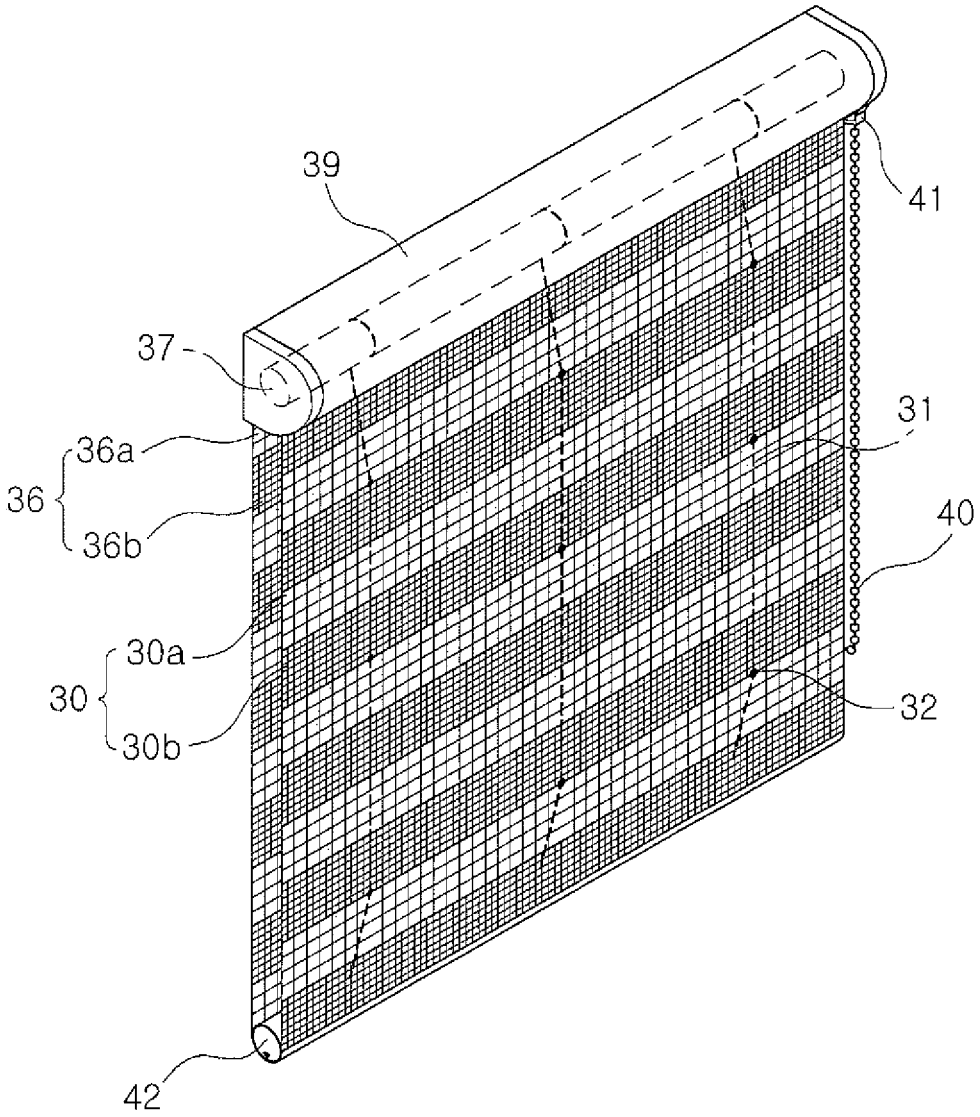
FIG. 15 is a perspective view showing a roman blind according to a second embodiment of the present invention.

FIG. 15 is a perspective view showing a roman blind according to a second embodiment of the present invention. A roman blind according to the second embodiment of the present invention is different from the roman blind according to the first embodiment of the present invention in that the loop-forming fabric 30 and the roll-up fabric 36 respectively have the light-transmitting portions 30*a* and 36*a* and the light-shielding portions 30*b* and 36*b* formed alternately and repeatedly thereon. According to the second embodiment of the present invention, the loop cords 31 which are fitted to the loop-forming fabric 30 have the same colors as the loop-forming fabric 30 and the roll-up fabric 36, but in this case, the loop cords 31 may be exposed to the outside through the light-transmitting portions 30*a* of the loop-forming fabric 30, which makes the outer appearance thereof looks bad. Therefore, it may be more desirable to have the loop cords 31 made of a transparent material.

Figure 16A:
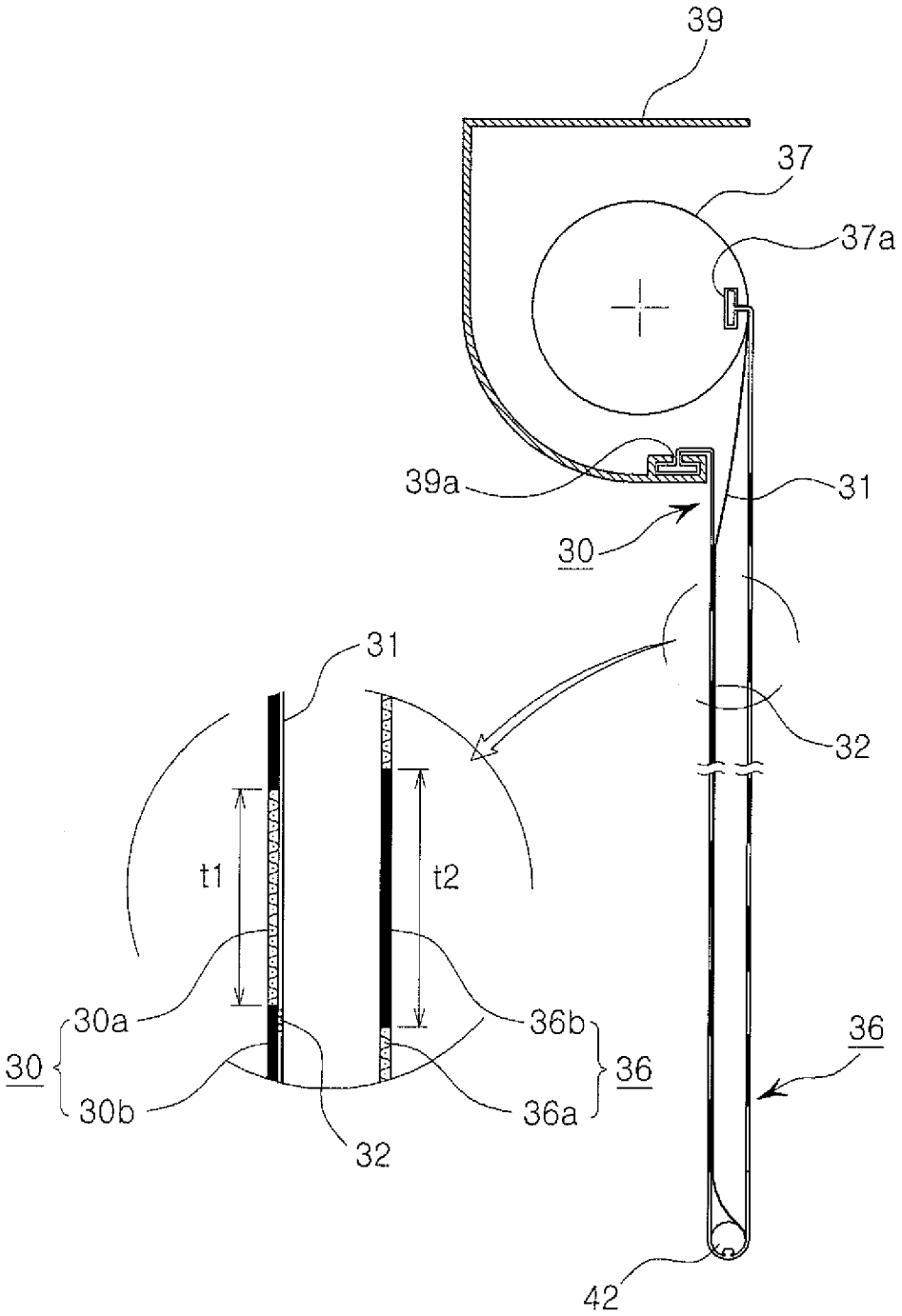
Figure 16B:
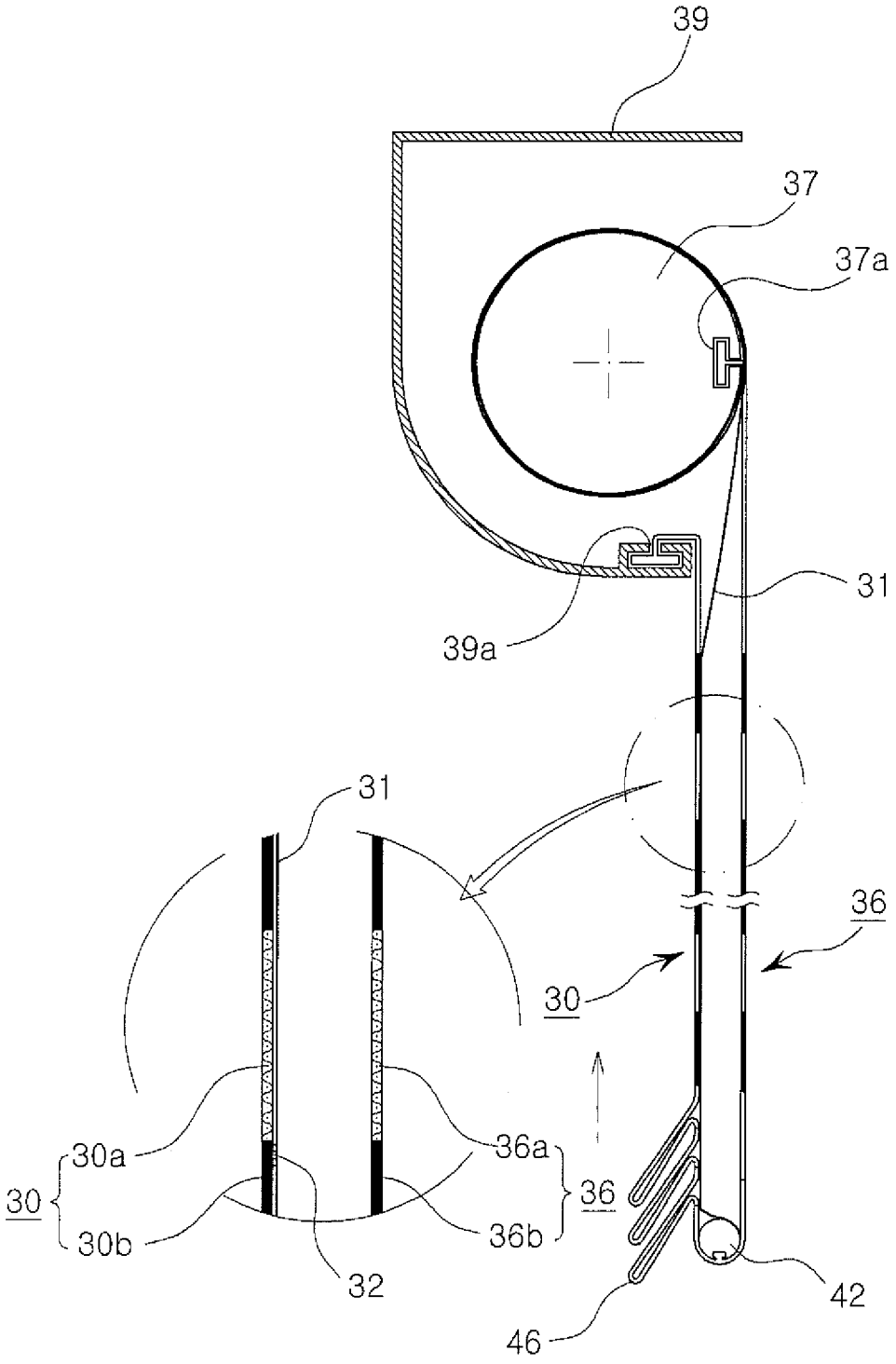

FIG. 16*a* shows the light-transmitting portions and the light-shielding portions of the loop-forming fabric being arranged alternately with those of the roll-up fabric, and FIG. 16*b* shows the light-transmitting portions and the light-shielding portions of the loop-forming fabric being arranged correspondingly to those of the roll-up fabric. In case of the blind according to the second embodiment of the present invention, as shown in FIG. 16*a*, the heights t1 of the light-transmitting portions 30*a* and 36*a* formed on the loop-forming fabric 30 and the roll-up fabric 36 are set lower than the heights t2 of the light-shielding portions 30*b* and 36*b* thereof. This allows the indoor and outdoor to be completely shielded when the light-transmitting portions 30*a* and the light-shielding portions 30*b* of the loop-forming fabric 30 are arranged alternately with the light-transmitting portions 36*a* and the light-shielding portions 36*b* of the roll-up fabric 36. Further, as shown in FIG. 16*b*, if the light-transmitting portions 30*a* and the light-shielding portions 30*b* of the loop-forming fabric 30 are arranged correspondingly to the light-transmitting portions 36*a* and the light-shielding portions 36*b* of the roll-up fabric 36, the daylight collection and ventilation of the indoor can be achieved, without having any operation of winding the roll-up fabric 36 covering the window on the winding rod 37.

Figure 17:
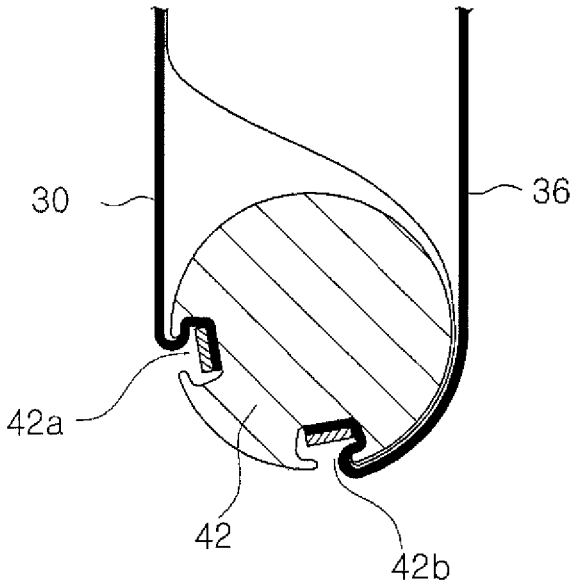
FIG. 17 is a longitudinal sectional view showing a first variation of the weight of the roman blind according to the present invention.

FIG. 17 is a longitudinal sectional view showing a first variation of the weight of the roman blind according to the present invention. According to the first variation, the weight 42 includes two mounting grooves 42*a* and 42*b* having a phase difference therebetween, one side mounting groove 42*a* being adapted to insertedly fix the loop-forming fabric 30 thereto and the other side mounting groove 42*b* being adapted to insertedly fix the roll-up fabric 36 and the loop cords 31, so that a loose loop is not formed and a flat state on the loop-forming fabric 30 can be maintained.

Figure 18A:
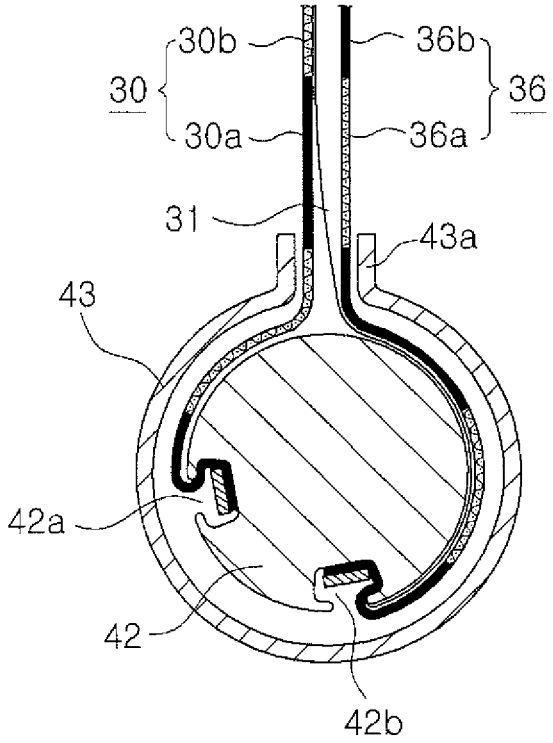
FIGS. 18*a* and 18*b* are longitudinal sectional views showing a second variation of the weight of the roman blind according to the present invention.
Figure 18B:
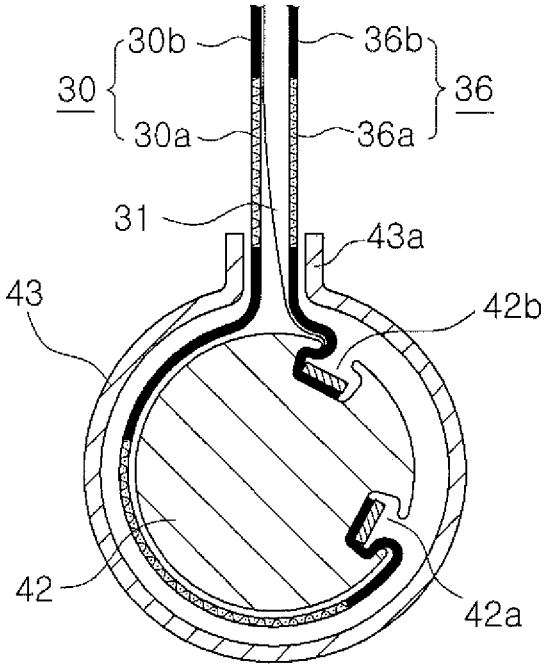

FIGS. 18*a* and 18*b* are longitudinal sectional views showing a second variation of the weight of the roman blind according to the present invention. In case of the first variation of the weight 42, the distance between the loop-forming fabric 30 and the roll-up fabric 36 is far from each other by the diameter of the weight 42, and therefore for the blind according to the second embodiment of the present invention where the light-transmitting portions 30*a* and 36*a* and the light-shielding portions 30*b* and 36*b* are formed on the loop-forming fabric 30 and the roll-up fabric 36, the indoor may be seen from the outdoor through the space between the loop-forming fabric 30 and the roll-up fabric 36.

Accordingly, as shown in FIGS. 18*a* and 18*b* a housing 43 surrounds the outer periphery of the weight 42 to allow the distance between the loop-forming fabric 30 and the roll-up fabric 36 to be shortened to a maximum degree. In this regard, the housing 43 has a neck portion 43*a* adapted to reduce the outer diameter of the weight 42 to a minimum size. The second variation of the weight 42 is more advantageous to the second embodiment of the present invention where the light-transmitting portions 30*a* and 36*a* and the light-shielding portions 30*b* and 36*b* are formed on the loop-forming fabric 30 and the roll-up fabric 36.

In this case, the distance between the loop-forming fabric 30 and the roll-up fabric 36 is shortened to a maximum degree, so that in the state where the light-transmitting portions 30*a* and 36*a* and the light-shielding portions 30*b* and 36*b* are arranged alternately with each other, as shown in FIG. 16*a*, the indoor is not seen from outdoors.

Figure 19A:
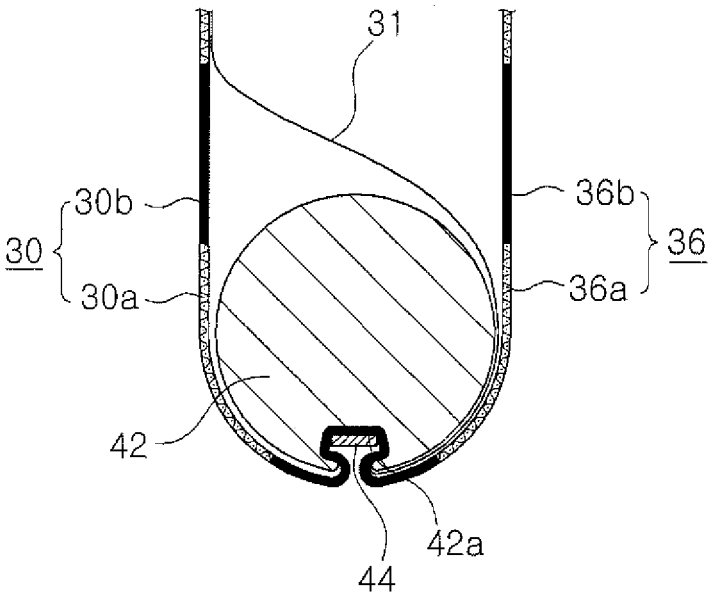
FIGS. 19*a* and 19*b* are longitudinal sectional views showing a third variation of the weight of the roman blind according to the present invention.
Figure 19B:
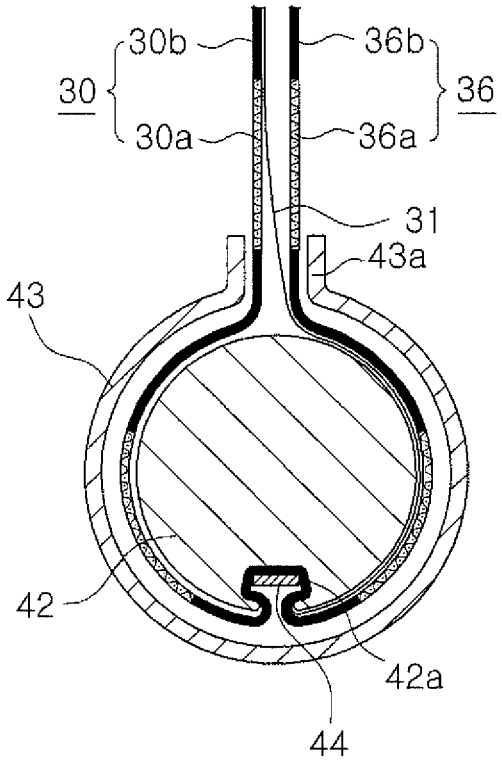

FIGS. 19*a* and 19*b* are longitudinal sectional views showing a third variation of the weight of the roman blind according to the present invention. According to the third variation, the loop-forming fabric 30 and the roll-up fabric 36 are fixed integrally to the weight 42, without having any connected portion therebetween. The third variation is appropriate for the first embodiment of the present invention where the loop-forming fabric 30 and the roll-up fabric 36 have only the light-shielding portions or to the second embodiment of the present invention where the light-transmitting portions 30*a* and 36*a* and the light-shielding portions 30*b* and 36*b* are arranged horizontally in a linear shape. The integral-type loop-forming fabric 30, the roll-up fabric 36, and the loop cords 31, which do not have any connected portions, may be positioned in the mounting groove 42*a* of the weight 42 and fixed at the same time thereto by means of a separate fixing piece 44.

Moreover, although the separate fixing piece 44 for fixing the blind fabric to the mounting groove 42*a* of the weight 42 may be used, it may be preferable to directly bond the weight 42 to one surface of the blind fabric, which allows the blind fabric to be fixed conveniently to the weight 42.

Figure 24A:
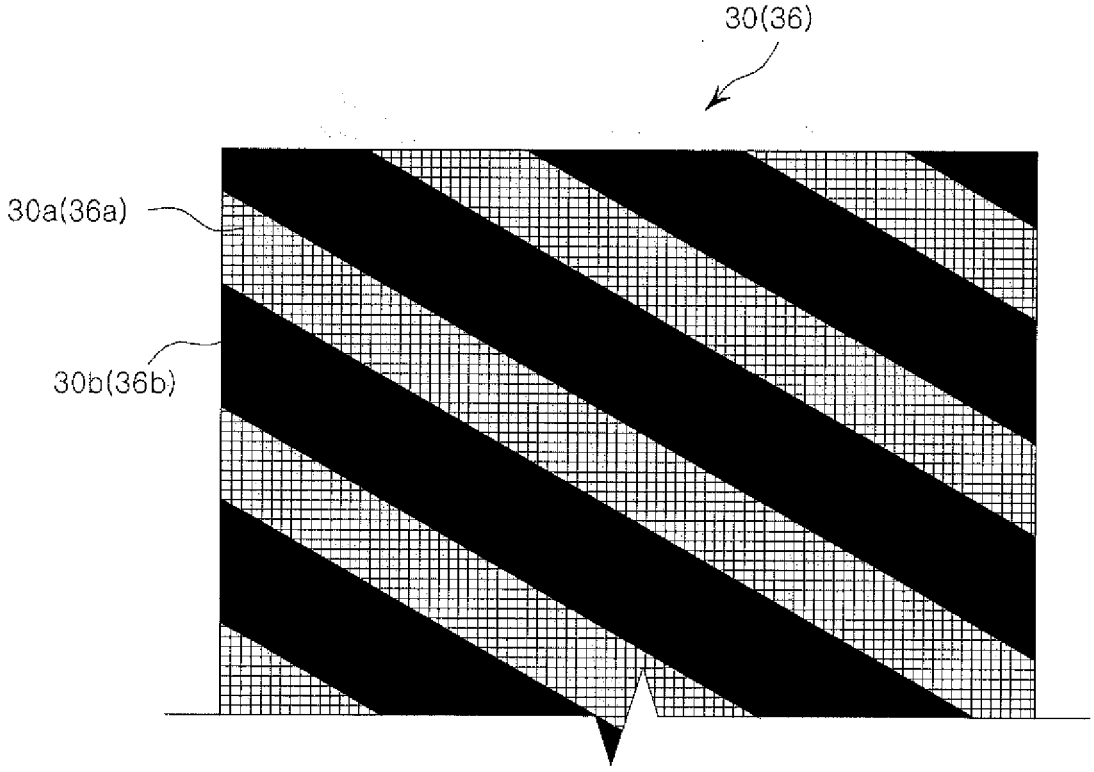
FIGS. 24*a* and 24*b* are front views showing the variations of the loop-forming fabric and the roll-up fabric according to the present invention.
Figure 24B:
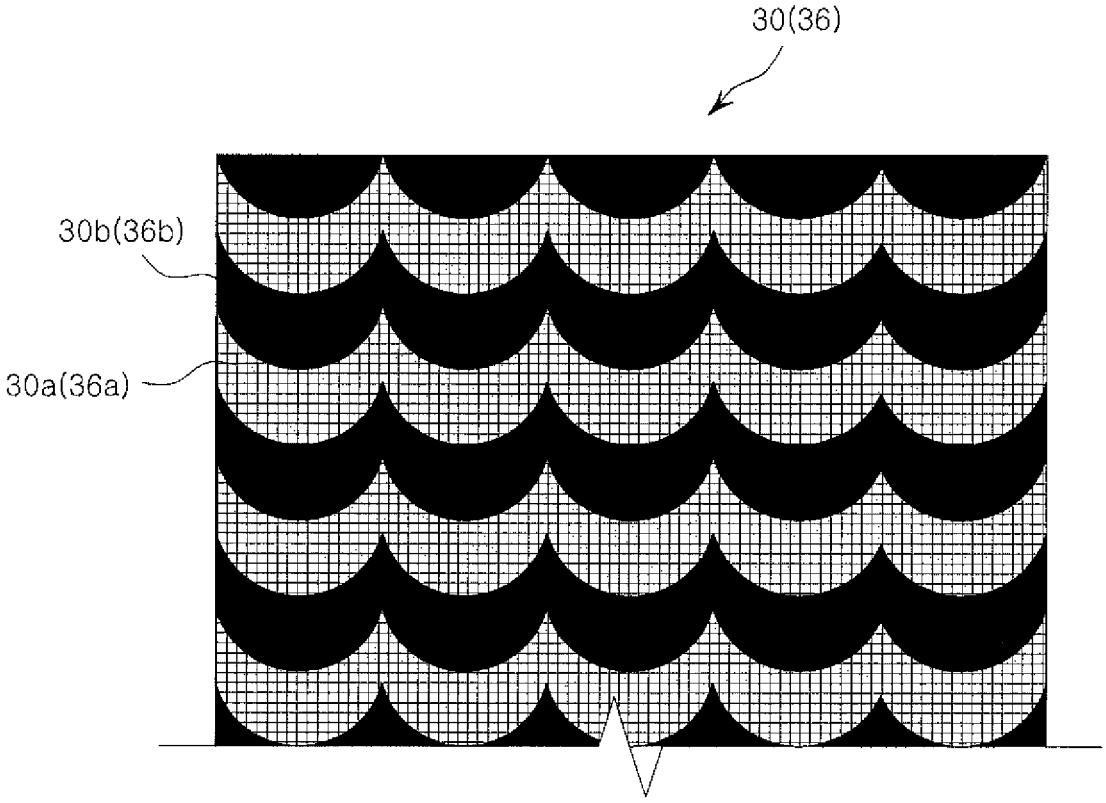

However, if the loop-forming fabric 30 and the roll-up fabric 36 have the light-transmitting portions 30*a* and 36*a* and/or the light-shielding portions 30*b* and 36*b* formed slantly thereon as shown in FIG. 24*a*, or the light-transmitting portions 30*a* and 36*a* and/or the light-shielding portions 30*b* and 36*b* formed in a form of waves as shown in FIG. 24*b*, the shapes on the front and back surfaces of the blind fabric are different from each other, so that the integral-type loop-forming fabric 30 and the roll-up fabric 36, which do not have any connected portion therebetween, cannot be applied to the weight 42. FIGS. 24*a* and 24*b* are front views showing the variations of the loop-forming fabric and the roll-up fabric according to the present invention.

As mentioned above, if the integrally connected loop-forming fabric 30 and roll-up fabric 36 surround the weight 42, the distance between the loop-forming fabric 30 and the roll-up fabric 36 is far from each other by the diameter of the weight 42, and therefore, the indoor may be seen from outdoors. This becomes more serious when the loop-forming fabric 30 and the roll-up fabric 36 have the light-transmitting portions 30*a* and 36*a* and the light-shielding portions 30*b* and 36*b* formed thereon. This problem can be solved by surrounding the outer periphery of the weight 42 by means of the housing 43, as shown in FIG. 19*b*, to allow the distance between the loop-forming fabric 30 and the roll-up fabric 36 to be shortened to a maximum degree.

Figure 20A:
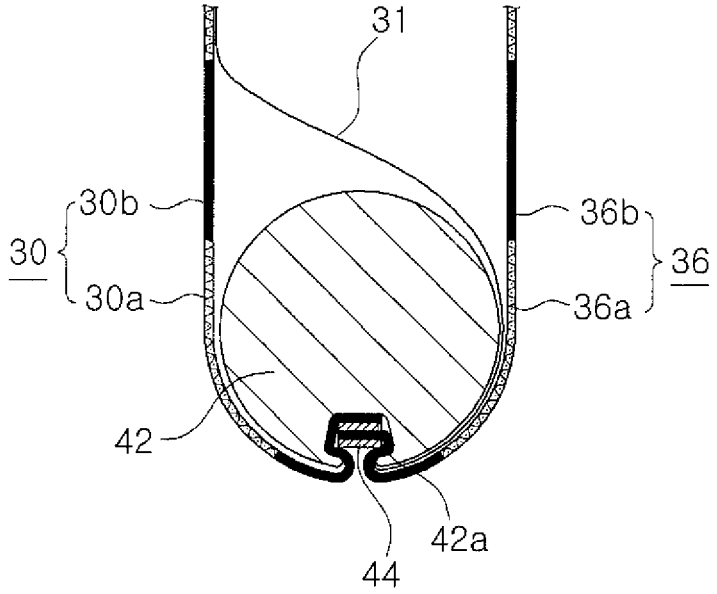
FIGS. 20*a* and 20*b* are longitudinal sectional views showing a fourth variation of the weight of the roman blind according to the present invention.
Figure 20B:
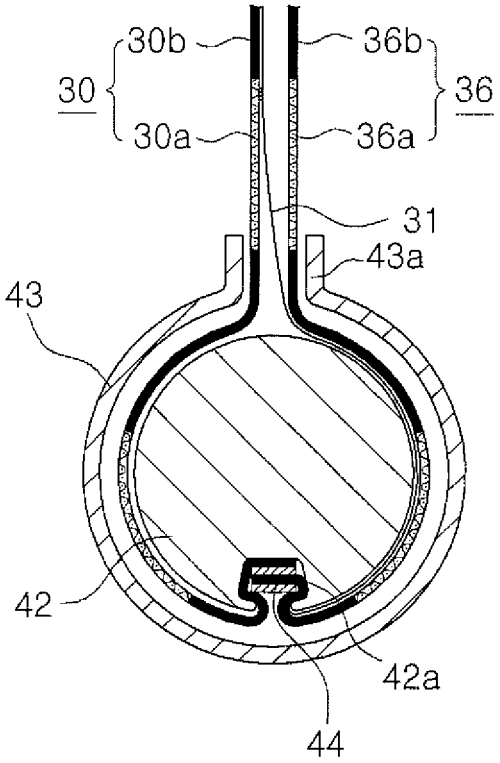

FIGS. 20*a* and 20*b* are longitudinal sectional views showing a fourth variation of the weight of the roman blind according to the present invention. The fourth variation may be applicable when the loop-forming fabric 30 and the roll-up fabric 36 are separately formed, not integrated with each other. That is, the fourth variation is to be applied when the light-transmitting portions 30*a* and 36*a* and the light-shielding portions 30*b* and 36*b* on the loop-forming fabric 30 and the roll-up fabric 36 are formed slantly or in a form of waves, as shown in FIGS. 24*a* and 24*b*, and not in a form of stripes. This may be done because when the loop-forming fabric 30 and the roll-up fabric 36 are integral with each other as shown in the third variation of the weight, the light-transmitting portions 30*a* and 36*a* and the light-shielding portions 30*b* and 36*b* of the loop-forming fabric 30 and the roll-up fabric 36 located in the front side and the back side, respectively, do not correspond to each other, thereby failing to shield the indoor and outdoor.

Accordingly, the loop-forming fabric 30 and the roll-up fabric 36 are separately formed. Next, as shown in FIG. 20*a*, the ends thereof are positioned into the mounting groove 42*a* of the weight 42, together with the loop cords 31 passed through the rings 32 formed on the back surface of the loop-forming fabric 30, and fixed at the same time to the mounting groove 42*a* by means of the separate fixing piece 44.

In this case, however, the distance between the loop-forming fabric 30 and the roll-up fabric 36 is far from each other by the diameter of the weight 42, and therefore, the indoor may be seen from outdoors. Accordingly, the heights of the light-shielding portions 30*b* and 36*b* should be set higher than those of the light-transmitting portions 30*a* and 36*a*, and thus, as shown in FIG. 20*b*, the housing 43 surrounds the outer periphery of the weight 42 to allow the distance between the loop-forming fabric 30 and the roll-up fabric 36 to be shortened to a maximum degree.

Figure 21A:
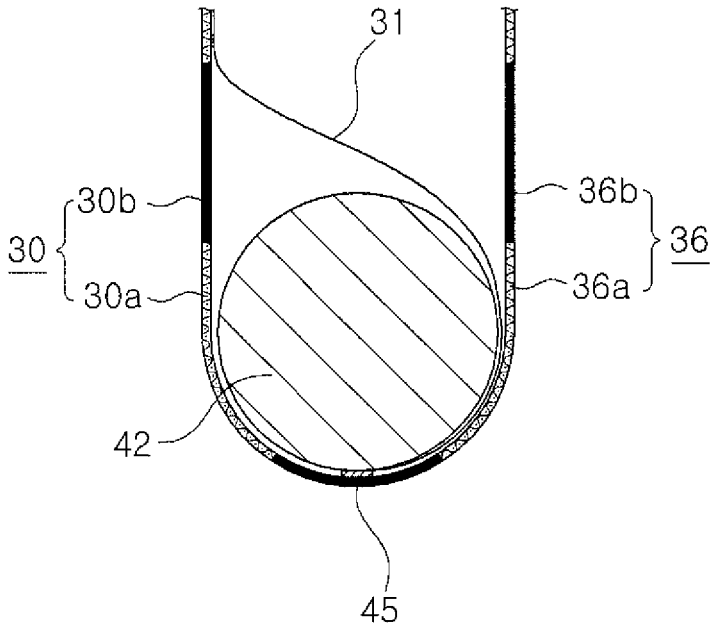
FIGS. 21*a* and 21*b* are longitudinal sectional views showing a fifth variation of the weight of the roman blind according to the present invention.
Figure 21B:
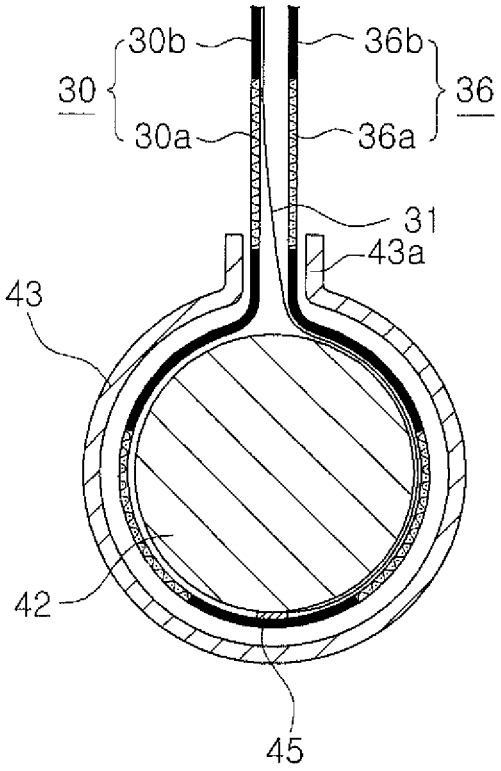

FIGS. 21*a* and 21*b* are longitudinal sectional views showing a fifth variation of the weight of the roman blind according to the present invention. The fifth variation is appropriate when the loop-forming fabric 30 and the roll-up fabric 36 have only the light-shielding portions formed thereon or when the light-transmitting portions 30*a* and 36*a* and the light-shielding portions 30*b* and 36*b* are formed horizontally in a linear shape.

Figure 22A:
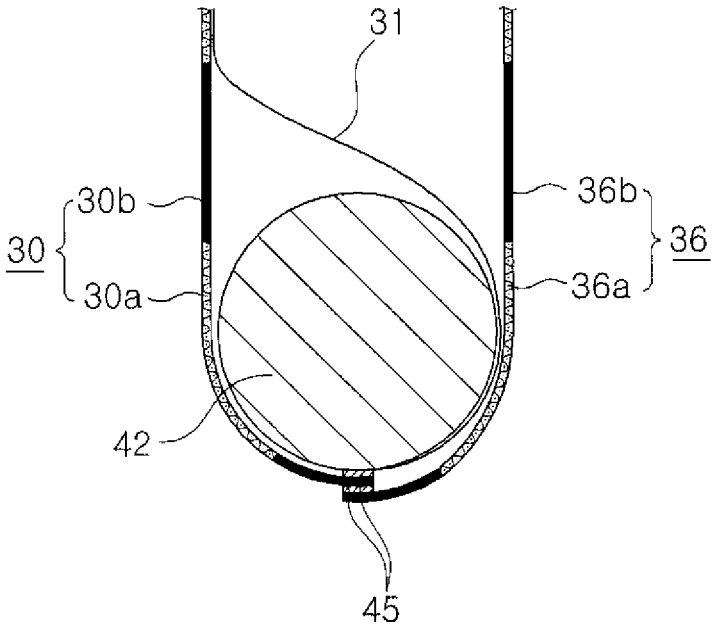
FIGS. 22*a* and 22*b* are longitudinal sectional views showing a sixth variation of the weight of the roman blind according to the present invention.
Figure 22B:
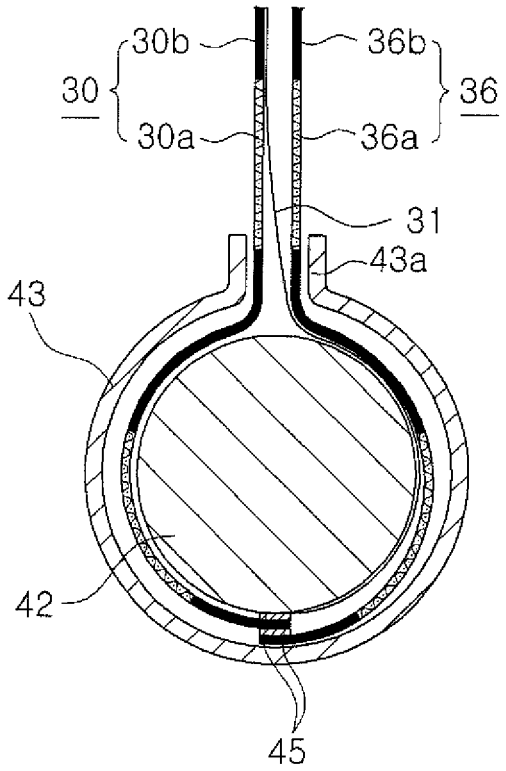

FIGS. 22*a* and 22*b* are longitudinal sectional views showing a sixth variation of the weight of the roman blind according to the present invention. The sixth variation may be applied when the light-transmitting portions 30*a* and 36*a* and the light-shielding portions 30*b* and 36*b* on the loop-forming fabric 30 and the roll-up fabric 36 are formed slantly or in a form of waves, and not in a form of stripes.

According to the fifth and sixth variations of the weight, the loop-forming fabric 30, the roll-up fabric 36, and the loop cords 31 are fixed to the weight 42 by means of fixing means 45 such as a bonding material or double side tape, without having any mounting groove 42*a* formed on the weight 42.

Figure 23A:
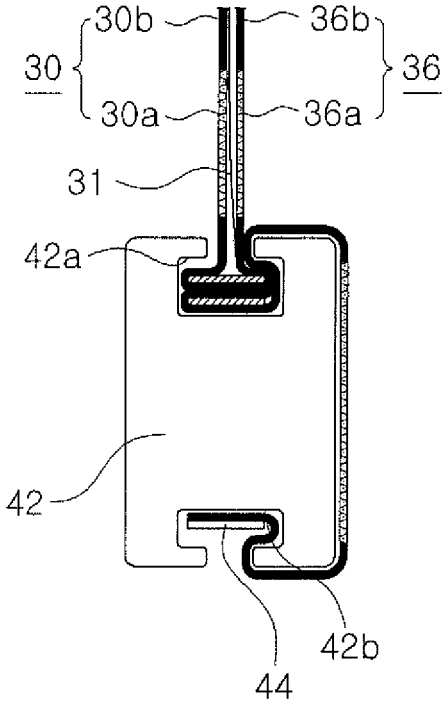
FIGS. 23*a* and 23*b* are longitudinal sectional views showing a seventh variation of the weight of the roman blind according to the present invention.
Figure 23B:
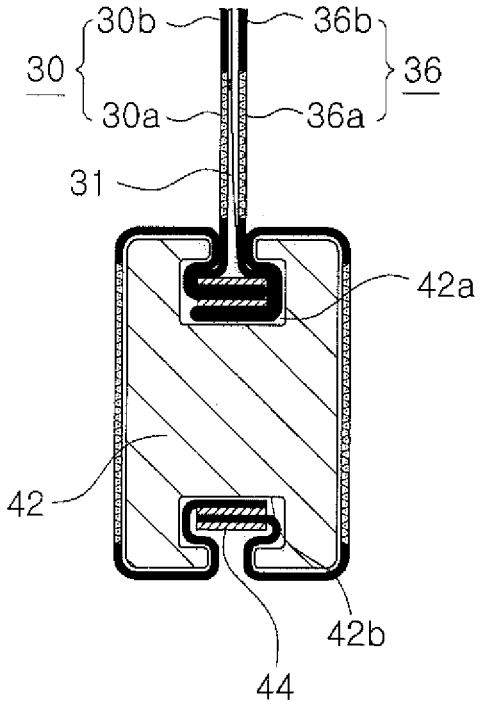

FIGS. 23*a* and 23*b* are longitudinal sectional views showing a seventh variation of the weight of the roman blind according to the present invention. The loop-forming fabric 30, the roll-up fabric 36, and the loop cords 31 are fixed to the weight 42, and if the roll-up fabric 36 and the loop cords 31 are wound or unwound on/from the winding rod 37 by pulling the adjustment cord 40, they are moved up or down together with the weight 42.

In this regard, FIG. 23*a* shows the configuration where a portion of the loop-forming fabric 30 located indoors is extended downwardly to surround the weight 42, and FIG. 23*b* shows the configuration where a portion of the roll-up fabric 36 as well as a portion of the loop-forming fabric 30 located indoors are extended downwardly, so that the loop-forming fabric 30 surrounds the front surface of the weight 42 and the roll-up fabric 36 surrounds the back surface of the weight 42.

The light-shielding portions 30*b* and 36*b* of the loop-forming fabric 30 and the roll-up fabric 36 can have plain patterns, but if necessary, they may have various drawings or at least one insertion portion 30*c*, as shown in FIG. 10, into which the rod 38 is inserted to provide more flat loops. Accordingly, the present invention does not have any limitation in the shapes of the loop-forming fabric 30 and the roll-up fabric 36.

Under the above-mentioned configuration of the roman blind according to the present invention, now, an explanation on the operation of the roman blind using the blind fabric will be given.

First, when weaving the blind fabric of the present invention, strands of warp yarns 34 are held onto a weaving machine (not shown), and as shown in FIG. 8*b*, weft yarns 33 are supplied between the strands of warp yarns 34 to weave the light-shielding portions 30*b* and 36*b*. That is, as shown in FIG. 6, the weft yarns are passed between the warp yarns 34 in a zigzag manner, thereby weaving the light-shielding portions 30*b* and 36*b*.

While weaving the light-shielding portions 30*b* and 36*b* by passing the weft yarns 33 between the warp yarns 34 in such a manner, rings 32 may be formed when the weft yarns 33, which were being supplied in a zigzag manner between the warp yarns 34, skip over the region where the rings 32 are to be formed without having any weaving, as shown in FIG. 8*a*.

In the operations described above, the loop cords 31 are held on the weaving machine, and the weft yarns 33 and the loop cords 31 are not woven together in other regions except the region where the rings 32 are formed, as shown in FIG. 8*b*. Conversely, the weft yarns 33 are passed to surround the loop cords 31 only in the region where the rings 32 are formed, as shown in FIG. 8*a*, thereby allowing the loop cords 31 to be inserted into the rings 32.

After the loop-forming fabric 30 as the blind fabric of the present invention is woven through the above-mentioned operations, the blind as shown in FIGS. 11 and 15 is assembled by using the blind fabric of the present invention.

As shown in FIGS. 12*a* and 16*a*, in the state where the roll-up fabric 36 and the loop cords 31 are completely unwound from the winding rod 37, the weight 42 is located at a lower dead point. At this time, according to the first embodiment as shown in FIG. 11, the loop-forming fabric 30 and the roll-up fabric 36 have just light-shielding portions formed thereon, so that the window is covered, and according to the second embodiment as shown in FIG. 15, the loop-forming fabric 30 and the roll-up fabric 36 have the light-transmitting portions 30*a* and 36*a* and the light-shielding portions 30*b* and 36*b* formed alternately with each other, so that the window is completely covered.

At the state where the weight 42 is located at the lower dead point, as mentioned above, even though the loop cords 31 are inserted into the rings 32 formed on the back surface of the loop-forming fabric 30, the loop cords 31 are completely surrounded by the roll-up fabric 36 and they are not exposed to the outside. Further, the lower ends of the loop-forming fabric 30 and the roll-up fabric 36 are contained by the weight 42 to prevent separation of the lower ends, thereby proactively preventing the loop cords 31 from being pulled by a child or wrapped around his neck and further avoiding the unexpected cutting of the loop cords 31 and safety accidents caused thereby.

Especially in the state where the loop-forming fabric 30 and the roll-up fabric 36 have the light-transmitting portions 30*a* and 36*a* and the light-shielding portions 30*b* and 36*b* formed thereon, if the adjustment cord 40 is pulled by a user to rotate the winding rod 37 in a counterclockwise direction of FIG. 16*a* so as to open a portion of the window, the roll-up fabric 36 and the loop cords 31 are wound at the same time on the winding rod 37. At this time, in case of the weight of FIG. 14 to which the loop-forming fabric 30, the roll-up fabric 36, and the loop cords 31 are fixed at the same time, the weight 42 is moved up by the extent of the roll-up fabric 36 and the loop cords 31 being wound on the winding rod 37, but the loop-forming fabric 30 fixed at one end thereof to the frame 39 forms a loose loop during an initial upward movement. After that, if the adjustment cord 40 is kept pulled to rotate the winding rod 37, the loops 46 form normal shapes.

On the other hand, in case of the weight of FIG. 17, and in case of the second embodiment of FIG. 16*a*, in the state where the weight 42 is positioned at the lower dead point, the loop-forming fabric 30 and the roll-up fabric 36 completely close the window, and in this state, if the adjustment cord 40 is pulled initially, the weight 42 is not moved up by the extent of the roll-up fabric 36 and the loop cords 31 being wound on the winding rod 37 like the first embodiment as shown in FIG. 12*a*, but the weight 42 is instead rotated.

Accordingly, during the initial upward movement of the weight 42, a loose loop is not formed on the loop-forming fabric 30, and the housing 43 surrounding the outer periphery of the weight 42 is moved up by a small degree in proportion to the rotating distance of the weight 42. Through the above operation, the moving distance of the weight 42 is very short, so that the covered state of the window through the loop-forming fabric 30 and the roll-up fabric 36 is maintained. That is, even in the state where the loop-forming fabric 30 is unfolded to provide no loop on the lower end thereof, the daylight collection and ventilation of the indoors can be achieved.

In this case, even in the state where the window is covered, the light-transmitting portions 30*a* and 36*a* and the light-shielding portions 30*b* and 36*b* of the loop-forming fabric 30 and the roll-up fabric 36 are arranged correspondingly to each other to allow the daylight collection and ventilation of the indoors to be achieved. After that, if the adjustment cord 40 is kept pulled to open the window, the roll-up fabric 36 and the loop cords 31 are wound on the winding rod 37 through the operation in the second embodiment of the present invention, thereby forming the loops 46 on the loop-forming fabric 30.

Even in the process where the loops 46 are formed on the loop-forming fabric 30 through the above operation, the light-transmitting portions 30*a* and 36*a* and the light-shielding portions 30*b* and 36*b* of the loop-forming fabric 30 and the roll-up fabric 36 are arranged correspondingly to each other or alternately with each other to allow the daylight collection and ventilation of the indoors to be appropriately adjusted.

As mentioned above, the weight 42 moving up in accordance with the rotation of the winding rod 37 is located behind the loops 46 formed on the lowermost end of the loop-forming fabric 30 as shown in FIG. 16*b* and the weight 42 is not exposed to the outside, thereby proactively preventing the outer appearance from being damaged.

In the preferred embodiments of the present invention, the loop-forming fabric 30 is located indoors, and the roll-up fabric 36 is located at the window side. If necessary, however, their location may be changed.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

The invention claimed is:

1. A roman blind comprising a frame, a winding rod, a weight, and a blind fabric having a loop-forming fabric and a roll-up fabric, the roman blind having loops being formed on the loop-forming fabric when an adjustment cord adapted to activate a winding unit is pulled, wherein:

the winding rod is mounted rotatably on the frame;

the roll-up fabric is disposed behind the loop-forming fabric;

the upper end of the roll-up fabric and the upper ends of loop cords adapted to be inserted into rings formed on the loop-forming fabric are fixed to the winding rod;

the upper end of the loop-forming fabric is fixed to the frame;

the lower ends of the loop-forming fabric, the loop cords, and the roll-up fabric are fixed to the weight; and the rings for inserting the loop cords are woven integrally with the loop-forming fabric to be formed transversely and longitudinally on the surface of the loop-forming fabric when the loop-forming fabric is woven.

2. The roman blind according to claim 1, wherein the loop-forming fabric, the roll-up fabric, and the loop cords are fixed together to any one side of the weight while surrounding the weight.

3. The roman blind according to claim 1, wherein the loop-forming fabric is fixed at the lower end thereof to any one side of the weight, and the roll-up fabric and the loop cords are fixed at the lower ends thereof to another side of the weight.

4. The roman blind according to claim 1, wherein the loop-forming fabric and the roll-up fabric are formed integrally with each other without having any connected portion therebetween.

5. The roman blind according to claim 1, wherein the loop-forming fabric and the roll-up fabric are formed separately from each other.

6. The roman blind according to claim 4, wherein the loop-forming fabric and the roll-up fabric are formed integrally with each other without having any connected portion therebetween, and the loop-forming fabric, the roll-up fabric, and the loop cords are fixed together to one side of the weight while surrounding the weight.

7. The roman blind according to claim 5, wherein the loop-forming fabric and the roll-up fabric are formed separately from each other, and the lower ends of the loop-forming fabric, the roll-up fabric, and the loop cords are overlapped with each other and fixed together while surrounding the outer peripheral surface of the weight.

8. The roman blind according to claim 6, wherein the loop-forming fabric, the roll-up fabric, and the loop cords are fixed to the outer peripheral surface of the weight by fixing means.

9. The roman blind according to claim 6, wherein the loop-forming fabric, the roll-up fabric, and the loop cords are fixed to a mounting groove formed on the weight by a separate fixing piece.

10. The roman blind according to claim 9, wherein the fixing piece is attached to any one surface of the loop-forming fabric and the roll-up fabric, or to each surface thereof.

11. The roman blind according to claim 6, wherein the outer peripheral surface of the weight is surrounded by a housing.

12. The roman blind according to claim 11, wherein the housing has a neck portion formed thereon.

13. The roman blind according to claim 1, wherein the weight has mounting grooves formed on the upper and lower portions thereof, the mounting groove formed on the upper portion thereof having the loop-forming fabric, the roll-up fabric, and the loop cords fixed thereto, and the loop-forming fabric is extended to the lower portion of the weight to surround the front surface of the weight to be fixed to the mounting groove formed on the lower portion of the weight.

14. The roman blind according to claim 13, wherein the roll-up fabric is extended to the lower portion of the weight to surround the back surface of the weight to be fixed to the mounting groove formed on the lower portion of the weight, together with the loop-forming fabric.

15. The roman blind according to claim 1, wherein the loop-forming fabric or the roll-up fabric has a light-transmitting portion or light-shielding portion formed thereon.

16. The roman blind according to claim 1, wherein the loop-forming fabric or the roll-up fabric has light-transmitting portions and light-shielding portions formed repeatedly thereon.

17. The roman blind according to claim 15, wherein the loop-forming fabric and the roll-up fabric have different thicknesses, colors, and tissues from each other.

18. The roman blind according to claim 1, wherein the loop cords are made of a transparent material.

19. The roman blind according to claim 1, wherein the weight has mounting grooves formed thereon and the mounting grooves have a phase difference from each other.

* * * * *